US006591775B2

(12) United States Patent
Robinson

(10) Patent No.: US 6,591,775 B2
(45) Date of Patent: Jul. 15, 2003

(54) UNMANNED OFFSHORE PLATFORM AND METHOD OF PERFORMING MAINTENANCE WORK THEREON

(75) Inventor: Robert Wilson Robinson, Chessington (GB)

(73) Assignee: Granherne International Limited (GB)

( * ) Notice: Subject to any disclaimer, the term of this patent is extended or adjusted under 35 U.S.C. 154(b) by 0 days.

(21) Appl. No.: 09/956,421

(22) Filed: Sep. 19, 2001

(65) Prior Publication Data

US 2002/0078874 A1 Jun. 27, 2002

Related U.S. Application Data

(63) Continuation of application No. PCT/EP00/02444, filed on Mar. 20, 2000.

(30) Foreign Application Priority Data

Mar. 19, 1999 (GB) ..... 9906453

(51) Int. Cl.[7] ..... B63B 35/44
(52) U.S. Cl. ..... 114/264; 114/365
(58) Field of Search ..... 114/264, 265, 114/258, 259, 365, 368, 369; 405/196, 195.1

(56) References Cited

U.S. PATENT DOCUMENTS

| | | | | |
|---|---|---|---|---|
| 3,575,005 A | * | 4/1971 | Sumner | 114/258 |
| 3,727,414 A | * | 4/1973 | Davies | 114/265 |
| 4,335,319 A | | 6/1982 | Mettersheimer | |
| 4,421,051 A | * | 12/1983 | Hammett | 114/264 |
| 4,471,708 A | | 9/1984 | Wilson | |
| 4,590,634 A | | 5/1986 | Williams | |
| 4,846,357 A | | 7/1989 | Sholl | |
| 5,706,755 A | | 1/1998 | O'Brien | |

FOREIGN PATENT DOCUMENTS

| | | | |
|---|---|---|---|
| GB | 1525501 | | 9/1978 |
| GB | 2028259 | | 3/1980 |
| GB | 2061833 | | 5/1981 |
| GB | 2 346 606 | * | 8/2000 |
| WO | WO 00/56982 | * | 9/2000 |

OTHER PUBLICATIONS

The Patent Office, British Patent Office, Search Report Under Section 17, Application No. GM 9906453.7, Jul. 26, 1999, 4 pages.

* cited by examiner

*Primary Examiner*—Sherman Basinger
(74) *Attorney, Agent, or Firm*—Haynes and Boone, LLP

(57) ABSTRACT

There is disclosed at least one embodiment for a system for use in performing maintenance work on an unmanned offshore platform, comprising a sea-going support craft for transporting a maintenance crew to the platform for performing maintenance work on the platform, a power generator on the craft, and at least one operating device on the platform, where the platform has a line for supplying power from the power generator to the operating device.

24 Claims, 21 Drawing Sheets

UNMANNED OFFSHORE PLATFORM AND METHOD OF PERFORMING MAINTENANCE WORK THEREON

This application is a continuation of international application number PCT/EP00/02444 filed Mar. 20, 2000 (status, abandoned, pending, etc.).

This invention relates to a method of performing maintenance work on an unmanned offshore platform using a maintenance crew and also to the unmanned offshore platform itself. The term "crew" as used herein means one or more crew members though normally the crew will contain a plurality of members.

Offshore platforms are either manned or (normally) unmanned. In the case of unmanned platforms, these are typically used where the well drilling operations have been completed and the oil or natural gas to be recovered is in production. However, such unmanned offshore platforms require periodic maintenance, for which purpose a maintenance crew has to visit the platform to carry out the necessary maintenance work. Sea access to offshore platforms can be limited by adverse weather conditions in many parts of the world. One such location of particular commercial importance is the North Sea. In such areas, helicopters have conventionally been used to transfer maintenance crews between their operating base, for example at an onshore location or at another offshore platform, and the unmanned offshore platform. In order that a helicopter can land on an offshore platform, a "helideck" has to be provided on top of the platform superstructure, on which the helicopter lands. The provision of such a deck adds considerably to the cost of the platform. Furthermore, in particularly adverse weather conditions it is not safe for the helicopter to land and take the crew back to base as soon as the maintenance work has been completed. Under those circumstances, the maintenance crew have to stay on board the platform until the weather settles down again. This can take a long time. Therefore, unmanned offshore platforms are provided with crew accommodation, which further adds to the cost of the platform. For all these reasons, a need exists for a low cost unmanned offshore platform, and also a system and method for safely and easily transporting maintenance crew between their base location and the unmanned offshore platform, even under adverse weather conditions.

Another problem arising with an unmanned offshore platform is that certain electrically or hydraulically driven services need to be operational, to enable the maintenance operations to be carried out. These services are not, however, needed most of the time, when the maintenance crew are not on the platform. Furthermore, the power consumption of such services is significantly larger than for the basic services that need to remain operational at all times, such as navigational aids and general instrumentation on the platform. Therefore, energy generators, such as electrical power generators or engine-driven hydraulic motors, have to be especially provided on board the platform for use when maintenance is to be carried out. This also adds to the cost of the platform where such generators or motors are permanently installed on the platform. If instead they are transported in the support craft, this is inconvenient for the crew, particularly when transporting such equipment from the craft to the platform.

Reference is made to the British patent application No. 99 03325.0 in the name of Caley Ocean Systems Ltd., filed Feb. 15, 1999, which discloses a hoisting apparatus for launch and recovery of a support craft from a manned or unmanned offshore platform, and a method of using the same in conjunction with an offshore platform and support craft for performing various functions, one of which can be maintenance, e.g. repair, work.

According to the present invention from one aspect, there is provided a system for use in performing maintenance work on an unmanned offshore platform, comprising a sea-going support craft for transporting a maintenance crew to the platform for performing maintenance work on the platform, a power generator on the craft, at least one operating device on the platform, a line connected to said operating device, and connector means for connecting the line to the power generator such that the latter can supply power to said operating device.

With this arrangement, the power supply needs of the platform during maintenance are met by the power generator on board the support craft. The need for power generation on the platform or transportation of power generation to the platform and transfer to its superstructure is avoided.

Preferably, the or one of the operating devices is a hoisting apparatus for raising the support craft to an elevated position, enabling the crew to transfer from the craft to the platform superstructure. Therefore, a simple, safe and reliable transfer of maintenance personnel to the unmanned platform can be achieved, even in adverse weather conditions. Furthermore, the need for a helicopter landing is avoided and the support craft held in its elevated position can serve to provide temporary crew quarters. Therefore, the cost of the unmanned platform is significantly lower than when helicopter landing facilities and crew accommodation have to be provided.

Conveniently, means, remotely operable from the craft, are provided on the platform for lowering the line to the craft.

The power generator is preferably an electrical power generator. However, it could alternatively be a hydraulic power generator.

Suitably, the electrical power generator can be arranged to be driven by the marine engine of said vessel, said engine being adapted to run when the support craft is held in its elevated position. Alternatively, it can be arranged to run independently of the marine engine of said craft, the generator being adapted to run when the support craft is held in its elevated position.

According to the invention from a second aspect, there is provided an unmanned offshore platform having a low maintenance self-sustainable power supply, a first electrical circuit including at least one first electrical device arranged to be powered by the power supply, and a second electrical circuit including at least one second electrical device, said second electrical circuit having no permanent power source on board the platform but having an electrical connection means for connecting to an external source of power on a sea-going support vessel for transporting maintenance crew to the platform. "Self-sustainable" as used throughout this specification denotes that the power supply ordinarily supplies power continuously despite the offshore platform being unmanned. This can be achieved by using a renewable energy source, such as solar, wind or wave powered, or an energy source that derives power from the well(s) from which the offshore platform is a production platform, or from neighbouring wells.

With this arrangement, the essential functional requirements of the platform, such as provided by the platform instrumentation and navigational aids and/or the ability to lower an umbilical line from the platform to the support craft, can be maintained at all times and functions needed only when maintenance crew periodically visit the platform, which generally have larger power requirements, are maintained by the generator on the support craft.

The power supply may comprise a self-sustainable energy source and a battery arranged to be recharged by the self-sustainable energy source. Suitably, the unmanned offshore platform includes two or more self-sustainable energy sources to provide alternative sources of energy. One, or more, of the self-sustainable energy sources may be a thermal electric generator arranged to burn gas from a gas well, for which said platform is a production platform. Alternatively, the, or one of the, self-sustainable energy sources is a photo-voltaic solar source.

In one preferred arrangement, the second electrical circuit is connected to the first electrical circuit through one-way converter means, to enable the external source of power on the support craft to re-charge the battery and energise the first electrical circuit when said external source of power is connected to the second electrical circuit.

The first electrical device(s) may comprise at least one of (i) a motor for driving a hydraulic package, (ii) a motor for operating an umbilical winch for lowering to the support craft an umbilical power line connected between said second electrical circuit and said connection means, (iii) instrumentation and (iv) navigational aids. The umbilical winch motor is preferably operable by remote control from the support vessel or from a host platform. The second electrical device (s) may comprise at least one of (i) a winch motor for raising and lowering the support vessel between sea level and an elevated position alongside the platform superstructure (ii) an electrically powered crane on the platform and (iii) an electrical distribution board.

It is advantageous for the unmanned offshore platform to include a support vessel raising and lowering apparatus on the platform superstructure, comprising a primary load-bearing line for connection to the craft, means operable for raising and lowering the primary line, a load member, a plurality of secondary lines connected to the load member, docking means on the load member for engagement with corresponding docking means on the support vessel, and means operable for raising and lowering the secondary lines independently of the load bearing line, said load member acting as a guide for the primary line. This arrangement is effective for easy and reliable docking with the support craft even in stormy weather conditions.

According to the invention from a third aspect, there is provided a system for use in performing maintenance work on an unmanned offshore platform, comprising a sea-going support craft for transporting a maintenance crew to the platform, an operating device on the platform, a hoisting apparatus on the platform which can be coupled to said support craft and is operable therefrom to raise the support craft from the sea to an elevated position alongside the platform superstructure, means on the platform remotely operable from the craft for lowering a line, connected to said operating device and said hoisting apparatus, to the craft before it is raised from the sea, and connector means for connecting the lowered line to the craft such that the latter can supply power to said operating device and said hoisting apparatus.

In this way, the power supply requirements of both the operating device and the hoisting apparatus are jointly met by supplying power from the support craft.

According to the invention from a fourth aspect, there is provided a method of performing maintenance work on an unmanned offshore platform using a maintenance crew, wherein the crew:

(i) are transported in a sea-going support craft to the platform;

(ii) connect a hydraulic pressure source on the craft to a hydraulic hoisting apparatus on the offshore platform;

(iii) operate the hoisting apparatus from the craft to raise the support craft from the sea to an elevated position;

(iv) transfer from the craft in elevated position to the platform superstructure; and (v) perform said maintenance work.

Conveniently after said maintenance work has been completed, the crew transfer back to the support craft in the elevated position, operate the hoisting apparatus to lower the craft down to the sea, and are transported away from the offshore platform in the vessel.

According to the invention from yet another aspect, there is provided a system for use in performing maintenance work on an unmanned offshore platform, comprising a sea-going support craft for transporting a maintenance crew to the platform, a hydraulic pressure source on the support craft, a hydraulic hoisting apparatus on the platform which can be coupled to said support craft and is operable therefrom to raise the support craft from the sea to an elevated position alongside the platform superstructure, means on the platform remotely operable from the craft for lowering a hydraulic line, connected to said hoisting apparatus, to the craft before it is raised from the sea, and connector means for connecting the lowered line to said hydraulic pressure source, such that the latter can supply hydraulic power to said hoisting apparatus.

Preferably the hoisting apparatus comprises a primary load-bearing line for connection to the craft, means operable for raising and lowering the primary line, a load member, a plurality of secondary lines connected to the load member, docking means on the load member for engagement with corresponding docking means on the support vessel, and means operable for raising and lowering the secondary lines independently on the load bearing line, said load member acting as a guide for the primary line.

A still further aspect of the invention provides a method of performing maintenance work on an unmanned offshore platform using a maintenance crew, wherein the crew:

(i) are transported in a sea-going support craft to the platform;

(ii) transfer from the craft, floating alongside the platform, to the platform superstructure;

(iii) connect a line connected to an operating device on the superstructure to a generator of power on the craft, for energising said operating device; and (iv) perform said maintenance work, step (iii) being performed before, during or after step (ii).

With this method, the advantage is achieved that the operating device on the superstructure is powered by the generator on the support craft. Furthermore, the cost of providing a hoisting apparatus for raising and lowering the craft is avoided. However, the method would normally only be suitable for use in less hostile weather and sea conditions, where the craft can be moored alongside the platform.

The generator of power, the line and the operating device may all be hydraulic, or they may be electrical.

For a better understanding of the invention and to show how the same may be carried into effect, reference will now be made, by way of example, to the accompanying drawings in which.

Figure 2:
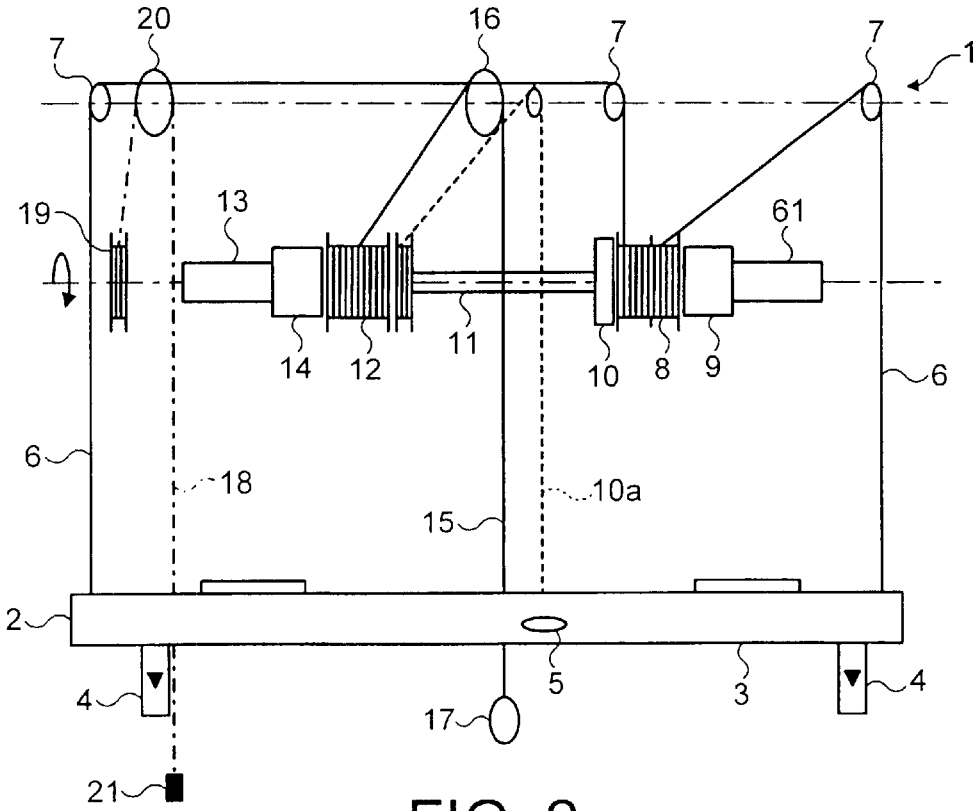
FIG. 2 is a schematic side elevation of a preferred form of hoisting apparatus for raising and lowering a craft to and from the platform.
Figure 2A:
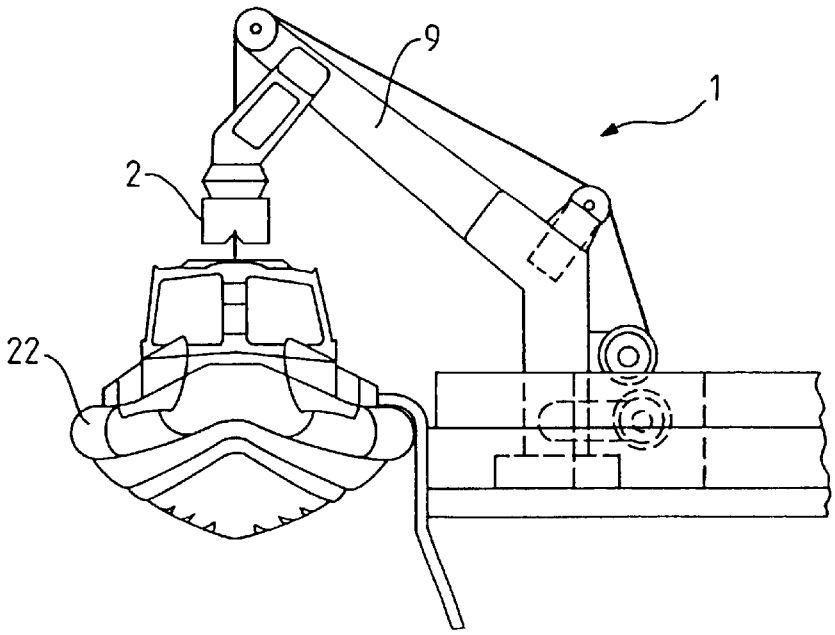
Figure 19:
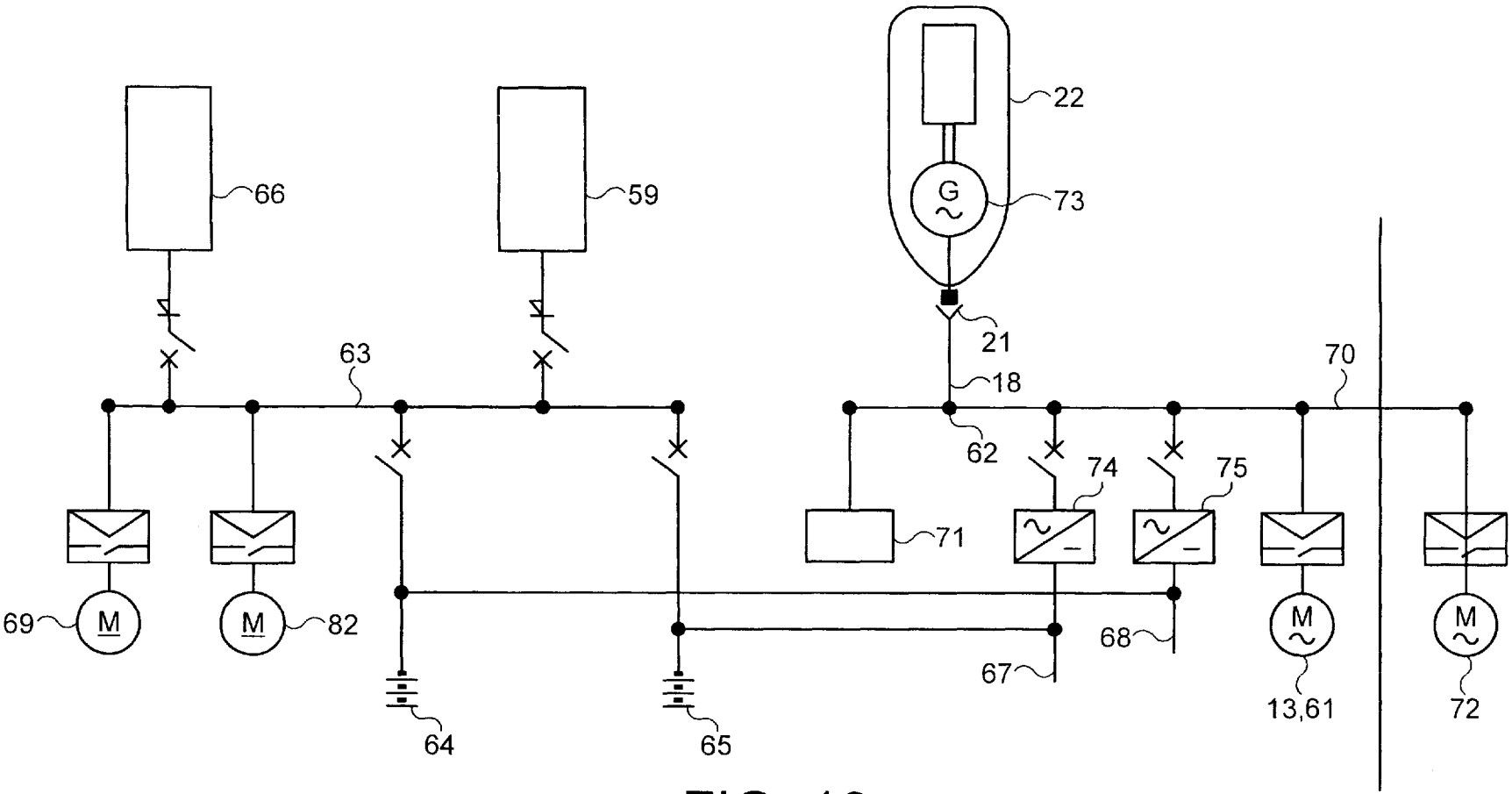
Figure 20:
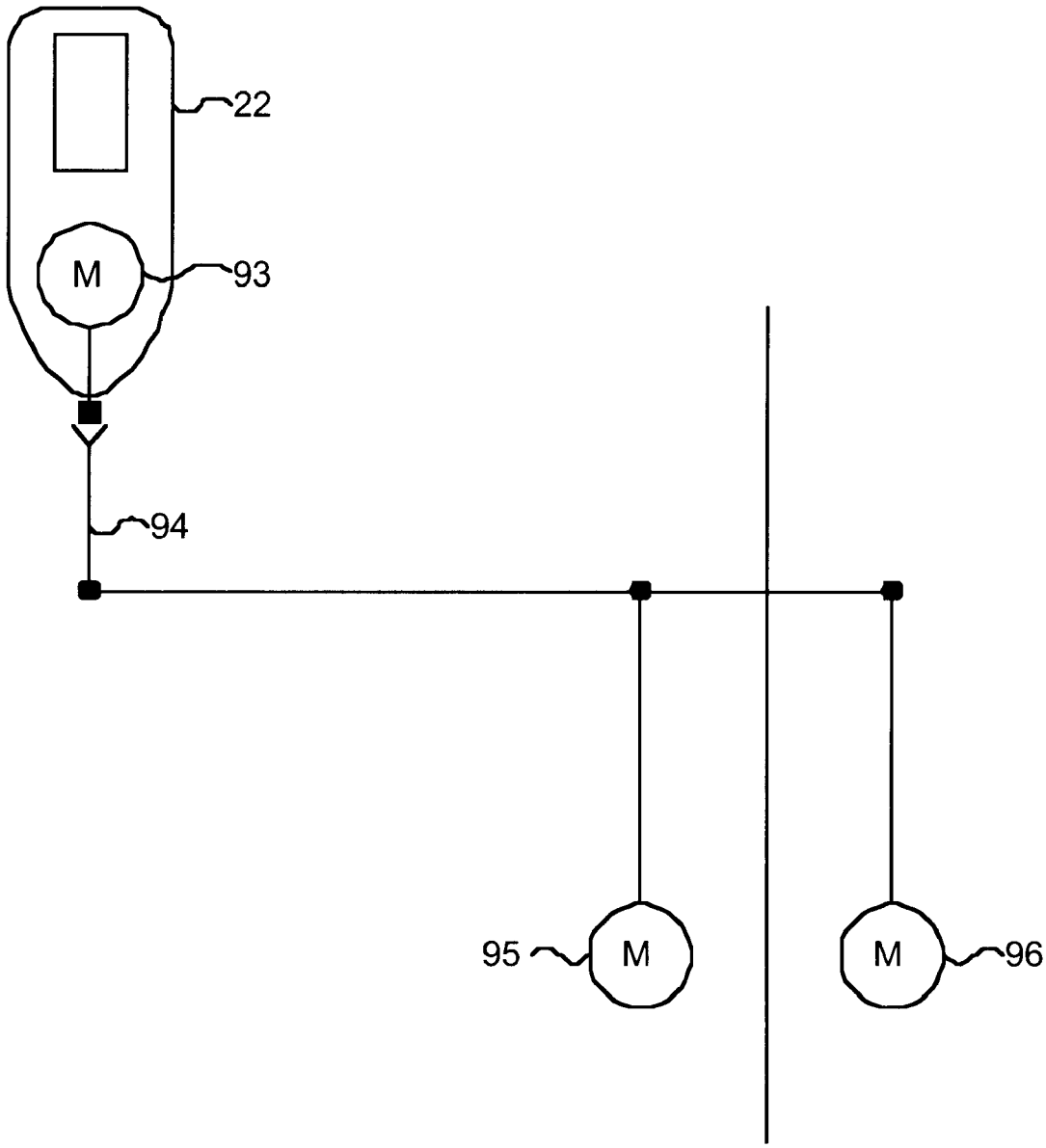

FIG. 2*a* is a schematic end elevation of the apparatus of FIG. 2 docked onto a craft;

FIGS. 3 to 14 are schematic illustrations of the chronological steps involved in the raising and lowering of the craft using the apparatus of FIG. 2;

FIGS. 15 to 18 are schematic illustrations of the chronological steps involved in launching craft in an emergency situation;

FIG. 19 is a schematic view of the electrical circuitry installed in the superstructure;

FIG. 20 shows a modification using hydraulic circuitry; and

Figure 1:
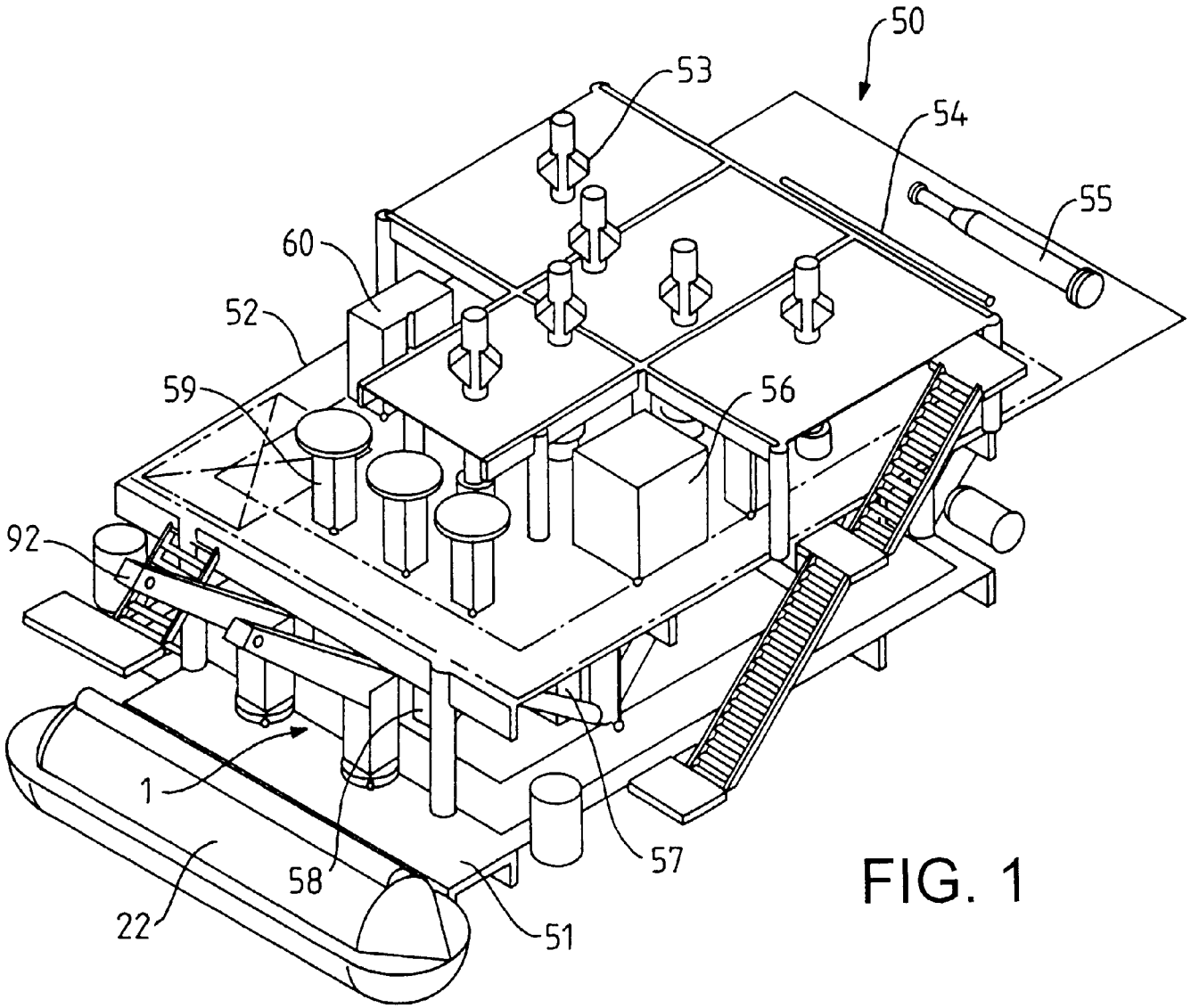
FIG. 1 is a perspective view showing the superstructure of an unmanned offshore platform forming a first embodiment of the invention.
Figure 21:
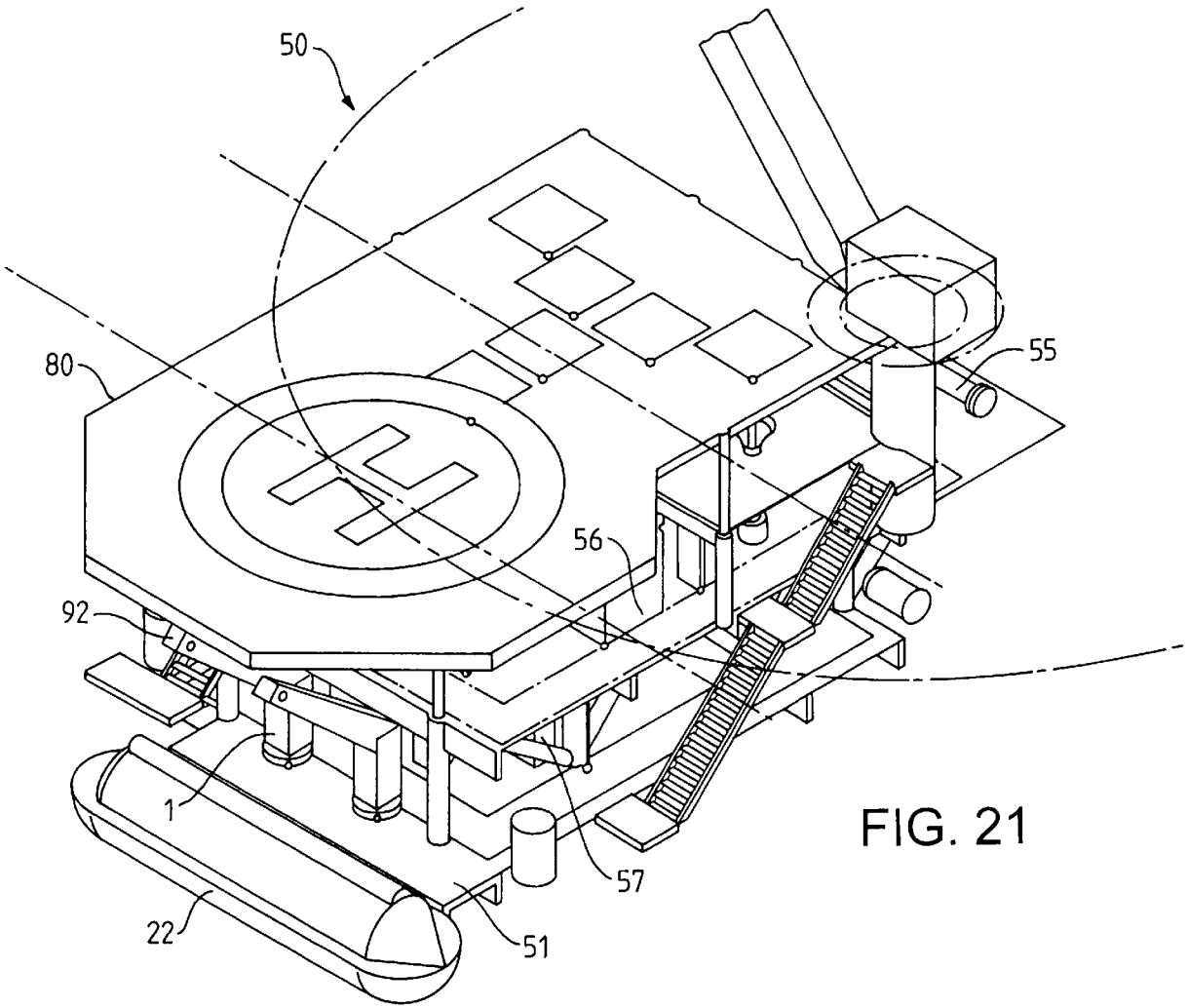

FIG. 21 is a view corresponding to that of FIG. 1, showing a second embodiment.

FIG. 1 shows the superstructure 50 of an unmanned offshore platform, whose legs are omitted from FIG. 1 in the interests of clarity. Whether the platform is anchored to the sea floor by means of its legs, or whether it is a submersible or semi-submersible is of no technical significance, though it is preferred for use in the North Sea that the platform is standing with its legs on the seabed.

The superstructure shown in FIG. 1 is of conventional construction for an unmanned wellhead platform and it will therefore be only briefly described. It comprises a main deck 52 with a cellar deck 51 supported beneath it. The superstructure includes conventional wellhead trees 53 and a manifold 54 having export via a riser with an emergency shut-down valve (not shown). optionally, a pig launcher/receiver 55 is also included. The wells from which the platform is producing oil or gas are controlled by wellhead unit 56. The platform also includes electrical systems and navigational aids 57, which are powered by a battery bank 58 supported by a self-sustainable energy source such as thermal electric generators 59 fed by gas from the wells or pipeline. A fuel gas dehydration unit 60 serves to clean the fuel gas fed to the thermal electric generators 59. Access to and off the platform is by means of a sea-going support craft 22 using a davit 1, serving as hoisting apparatus for lowering and raising the craft between the level of the main deck 51 and the sea surface.

The unmanned offshore platform does not ordinarily have any sea-going support craft 22 suspended from the davit 1. When, it is necessary, periodically, for a maintenance crew to visit the platform to perform desired maintenance operations, the crew set off from base, eg. another manned offshore platform, a marine vessel such as a standby boat or an onshore location, in a sea-going support craft 22 which is used to transport them to the platform. Following arrival of the crew at the platform, the davit 1 is operated by the crew in the support craft to payout one or more hoisting lines which the crew secure to the sea-going craft waiting alongside the offshore platform, and then the davit is operated to hoist the sea-going support craft up to the level of the cellar deck 51, so that the crew can then step across onto the cellar deck 51.

Because the platform is unmanned, suitable controls accessible to the crew on the support craft have to be provided for operating the davit. Such controls can be provided on the platform leg structure approximately at the level of the main deck of the craft. However, to avoid having to bring the waiting craft up close to the leg structure or having crewmen step across the craft to a landing stage on the leg structure in order to operate the controls, it is preferred that there be a remote control system, such as radio communication, between the craft and the davit, or between a separate host platform, which could act as a base for the crew, and the davit, so that the davit can be instructed to lower the hoisting line(s) when the crew wish to transfer to the platform superstructure. The precise constructional form that the davit has and the manner in which it is operated are not material, so long as the davit can provide the required function of raising and lowering the sea-going support craft between the sea surface and the main deck of the superstructure. However, it is preferred that the davit 1 be of the form now to be described with reference to FIGS. 2 to 13.

As shown in FIG. 2, the davit or apparatus 1 comprises a frame 2 which can be raised or lowered from angled support arms 92 of the davit 1. In the arrangement shown, the frame is substantially rectangular and is provided, on the underside 3 thereof, with means 4 for connecting the frame to the support craft. The connectors 4 may be of any suitable form such as, for example, mechanical latches which engage with corresponding docking points on the craft.

The frame is supported at each side by a secondary line 6, which pass over a series of sheaves 7 to a winch 8 such that rotation of the winch raises or lowers the frame. In the embodiment shown, both secondary lines 6 are wound onto a single winch 8. A variable speed electric (or hydraulic) powered motor 61 is mounted adjacent to the winch 7 and the output shaft of the motor is connected through a gearbox 9 to the winch. A safety braking system 10 such as for example a sprag clutch/fail-safe brake and brake release cable 10*a* with operating handle 5 is also provided on the winch.

The winch 8 is mounted on a propshaft 11 on which is mounted a further winch 12 which is connected to the output shaft of a further variable speed electric (or hydraulic) motor 13 through a suitable gearbox 14. A load-bearing line 15 is wound onto the second winch 12 and passes over a sheave 16 and depends through the frame 2. The free end of the load-bearing line terminates in a connector 17.

In one arrangement, an umbilical power line 18 is provided for connection to the craft during operation. The umbilical line is connected to a power input socket 61 (see FIG. 19) on the apparatus and is wound around a tension reel 19 and sheave arrangement 20 to depend through the frame 2. The free end of the umbilical line terminates in a connector 21 for engagement in a corresponding socket on the craft to provide power from the craft to the apparatus 1.

The operation of the apparatus will now be described with reference to FIGS. 3–14 of the drawings. In these drawings, the craft 22 is to be recovered to and (when the maintenance work has been completed) launched from the unmanned wellhead platform 23.

Figure 3:
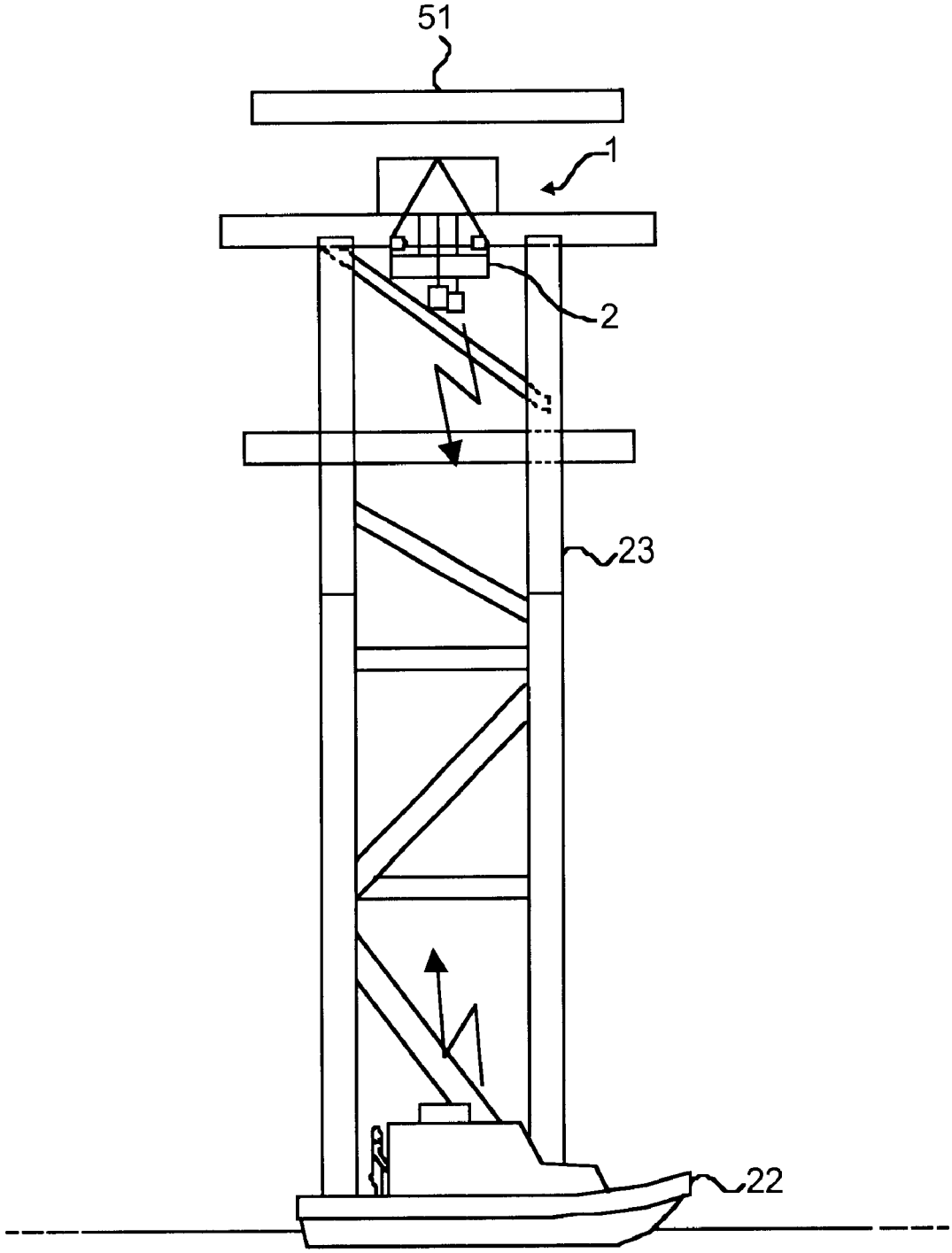
Figure 4:
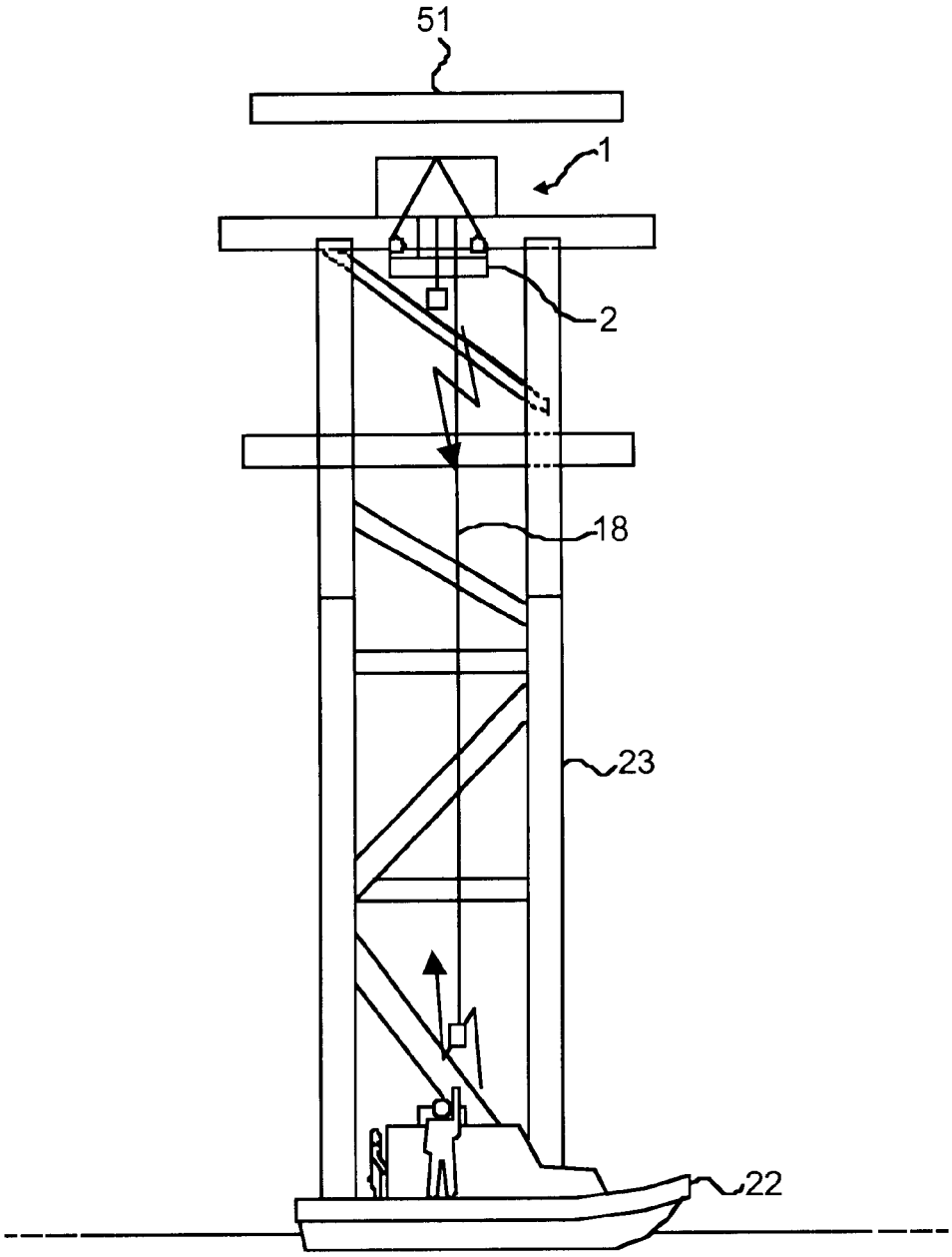

As shown in FIG. 3, the craft 22 sails under the platform to a waiting or recovery position in which the status of the platform can be assessed. Where the recovery apparatus 1 is fitted with an umbilical line 18 (such as in FIG. 2), a radio signal is transmitted from the craft 22 to a receiver (not shown) on the platform and the umbilical line is lowered to the craft (FIG. 4). Alternatively, the crew can communicate by radio with the host platform, which can then instruct the umbilical to be lowered. The umbilical line is then connected to a suitable socket on the craft by the crew to supply power to the platform electrical systems and allow for remote control operation of the apparatus 1 from the craft 22. The manner in which power is made available for operating the radio receiver and lowering the umbilical line is described below with reference to FIG. 19.

Figure 5:
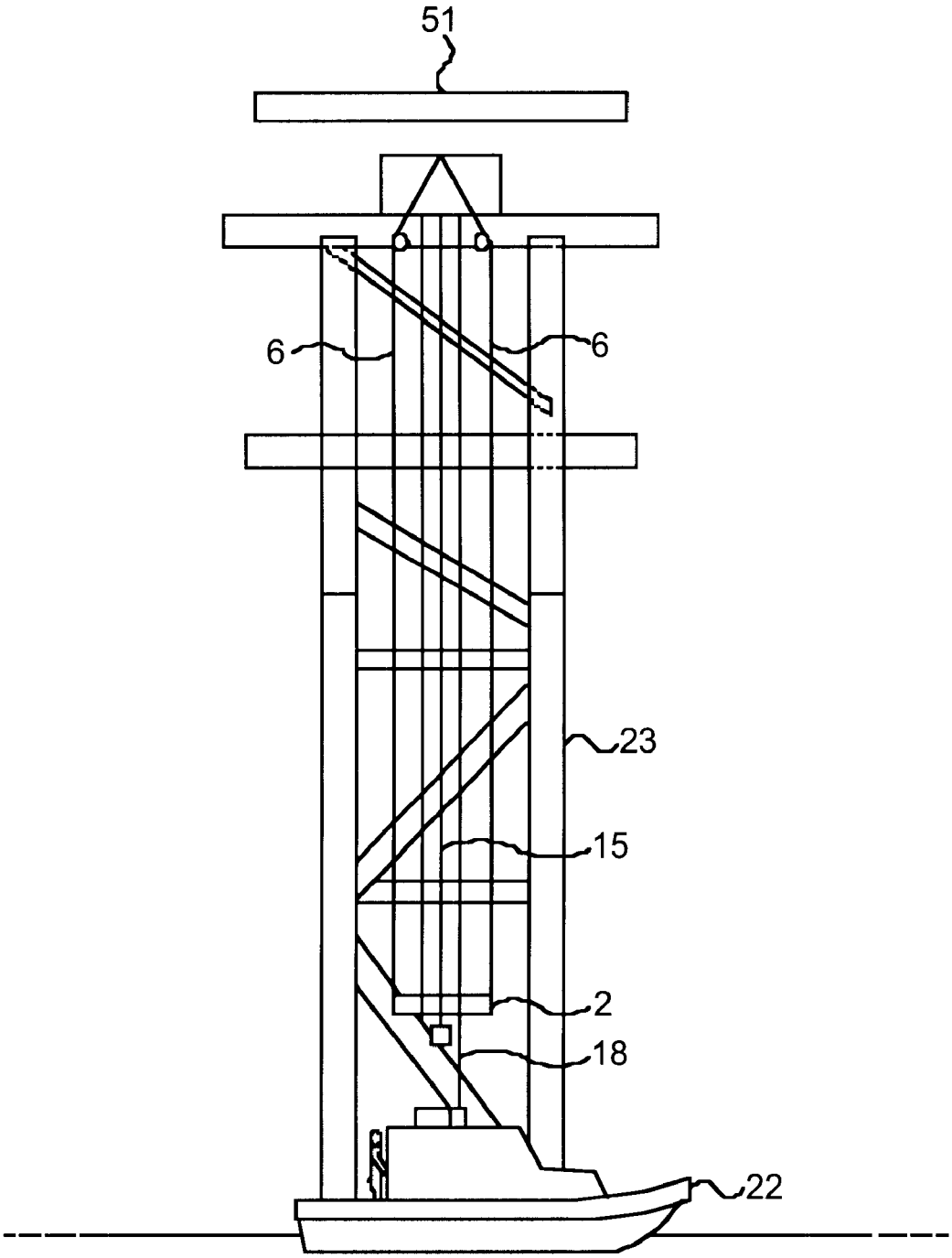

With the umbilical line in place, a signal is sent to the apparatus 1 and the electric motors 61, 13 are operated to lower the frame 2 and the load-bearing line 15 to a position approximately 4 meters above the craft (FIG. 5). The load-bearing line 15 is then lowered further through the frame 2 and the connector 17 on the free end of the load-bearing line is engaged on a corresponding loading point on the craft (FIG. 6) by a crew member.

Figure 7:
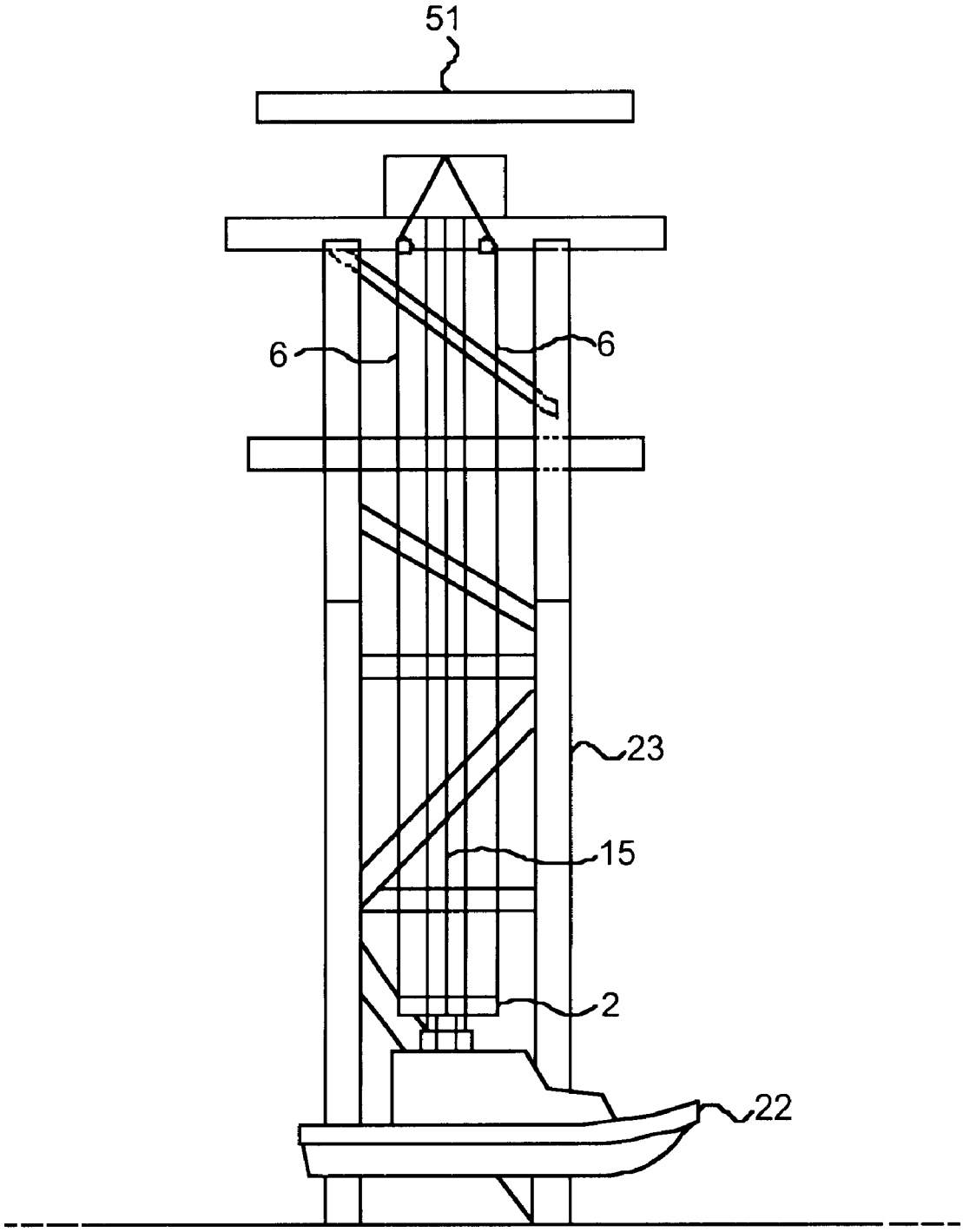

The heading of the craft 22 is then set on a compass on the craft and a signal sent to the apparatus via the umbilical line 18 to lift the craft into the frame 2 guided by a docking device. The connectors 4 on the underside 3 of the frame engage with the corresponding docking points on the craft (FIG. 7). The connectors may then be held in the docked position, for example by suitable locking means in order to firmly retain the craft in the frame.

Figure 8:
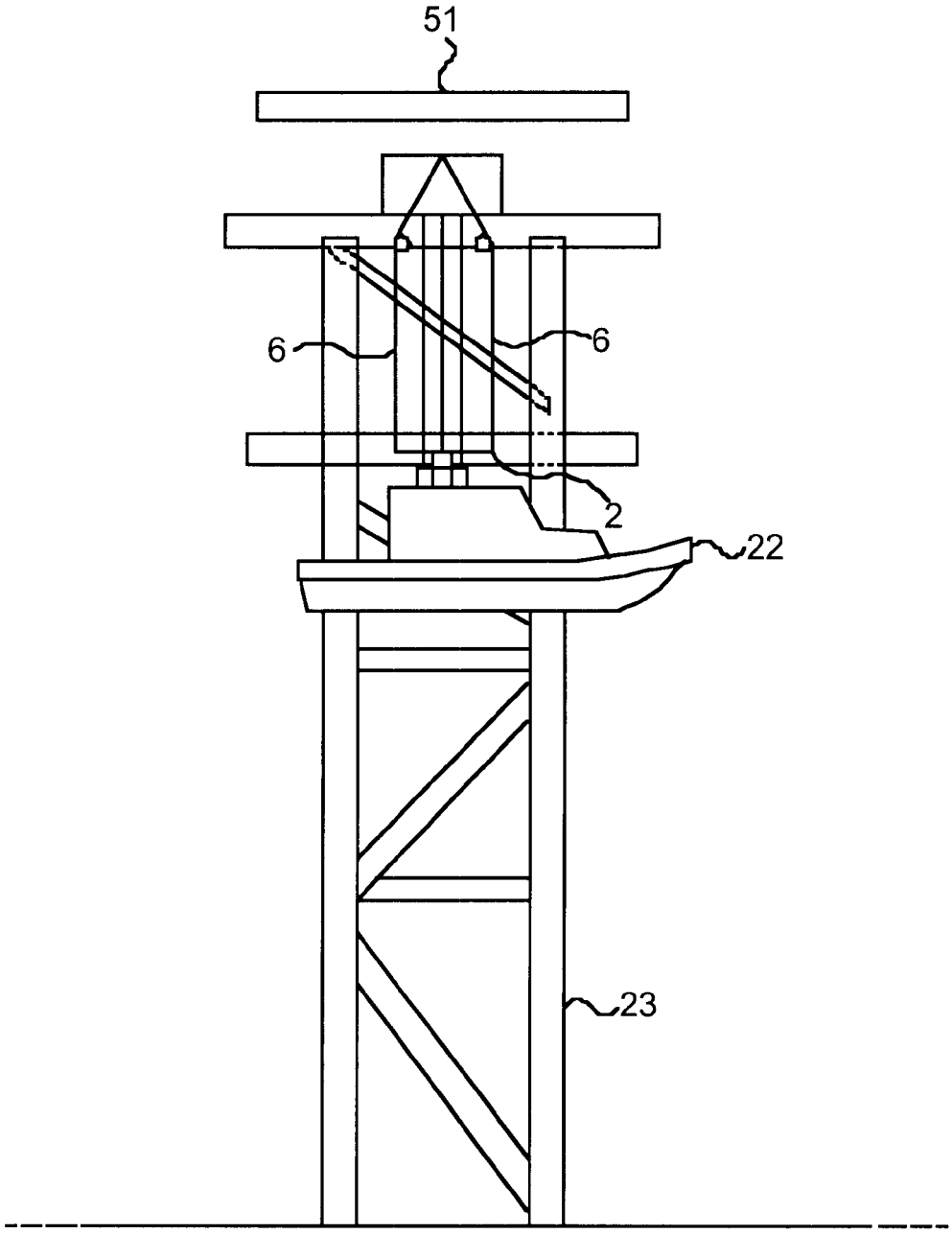
Figure 9:
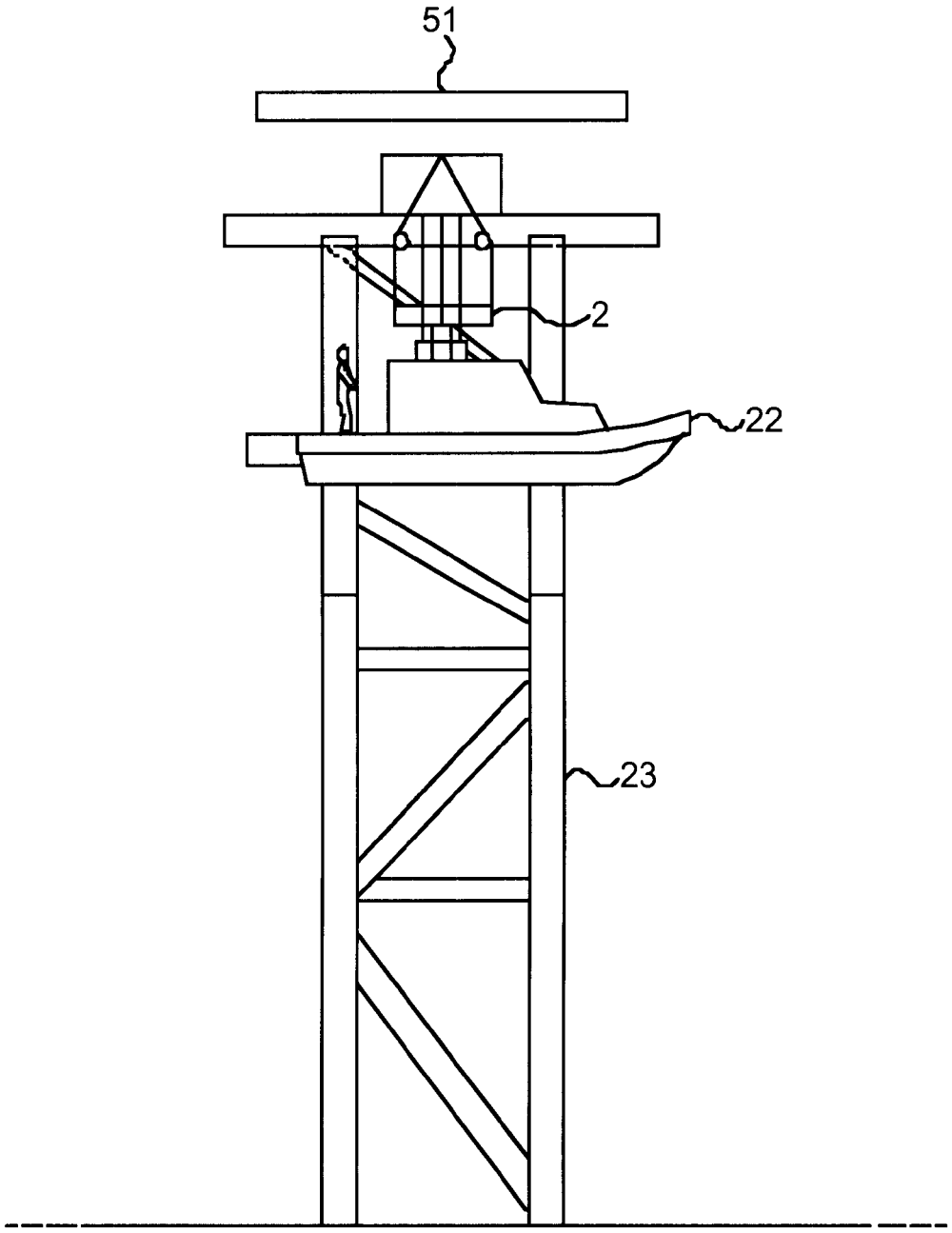

A signal is then sent to the apparatus 1 to raise the frame 2 and the load-bearing line 15 thereby raising the craft 22 safely to the top of the platform 23. As the craft is raised, the load-bearing line 15 and the secondary lines 6 are wound onto the respective winches 61, 12 (FIG. 8). As the craft approaches the top of the platform, the speed of ascent is reduced.

When the craft has been raised to the top of the platform (FIGS. 2*a* and 9), it can be secured in position by suitable securing means (not shown) and the crew of the craft can move to the platform to carry out the maintenance, e.g. repair, work as required.

Figure 10:
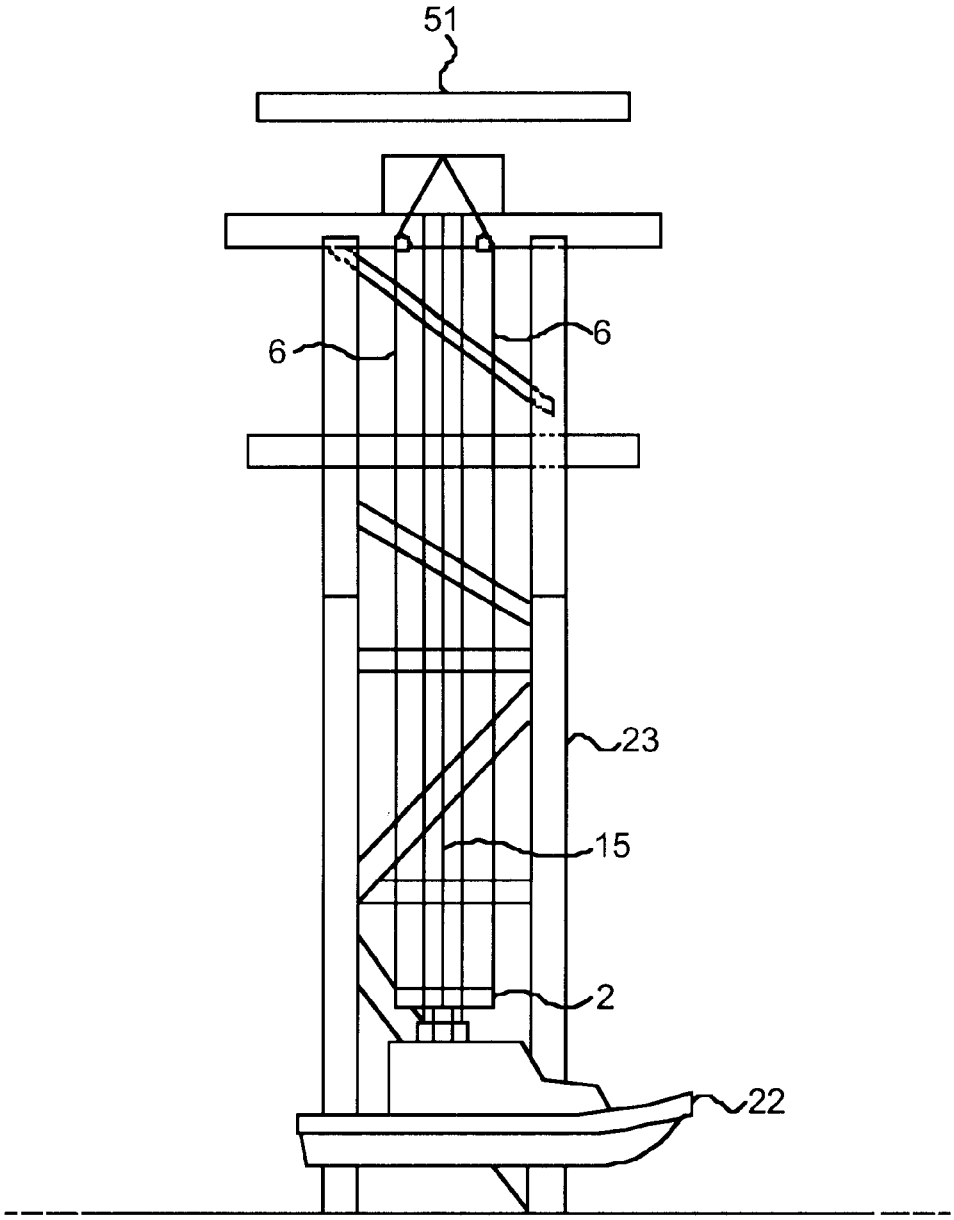

When the work has been completed, the crew move back to the craft 22 and release the securing means to release the craft from the platform 23. A signal is passed through the umbilical line 18 to the apparatus 1 to operate the motors 61, 13 to lower the frame 2, and the craft 22, to approximately 4 meters above the water (FIG. 10). As the secondary lines 6 on the frame 2 are wound around a single winch 8, they pay out at the same rate and this obviates the need for compensation means on the secondary lines. Furthermore, the stability and security of the craft 22 during the launch and recovery operations is greater than with only a single load-bearing line 15 and the hazards associated with connection of multiple load lines are mitigated.

Figure 11:
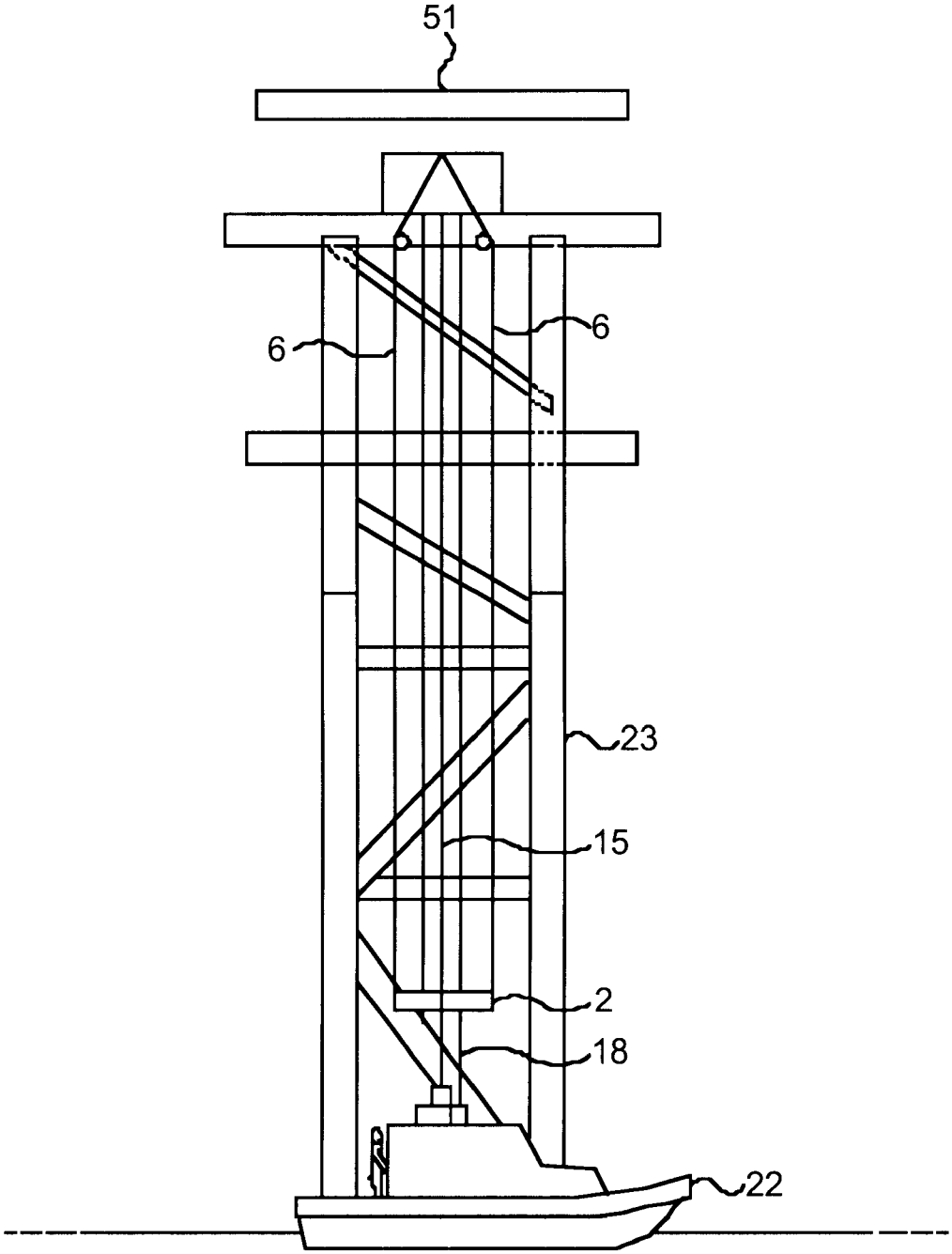
Figure 12:
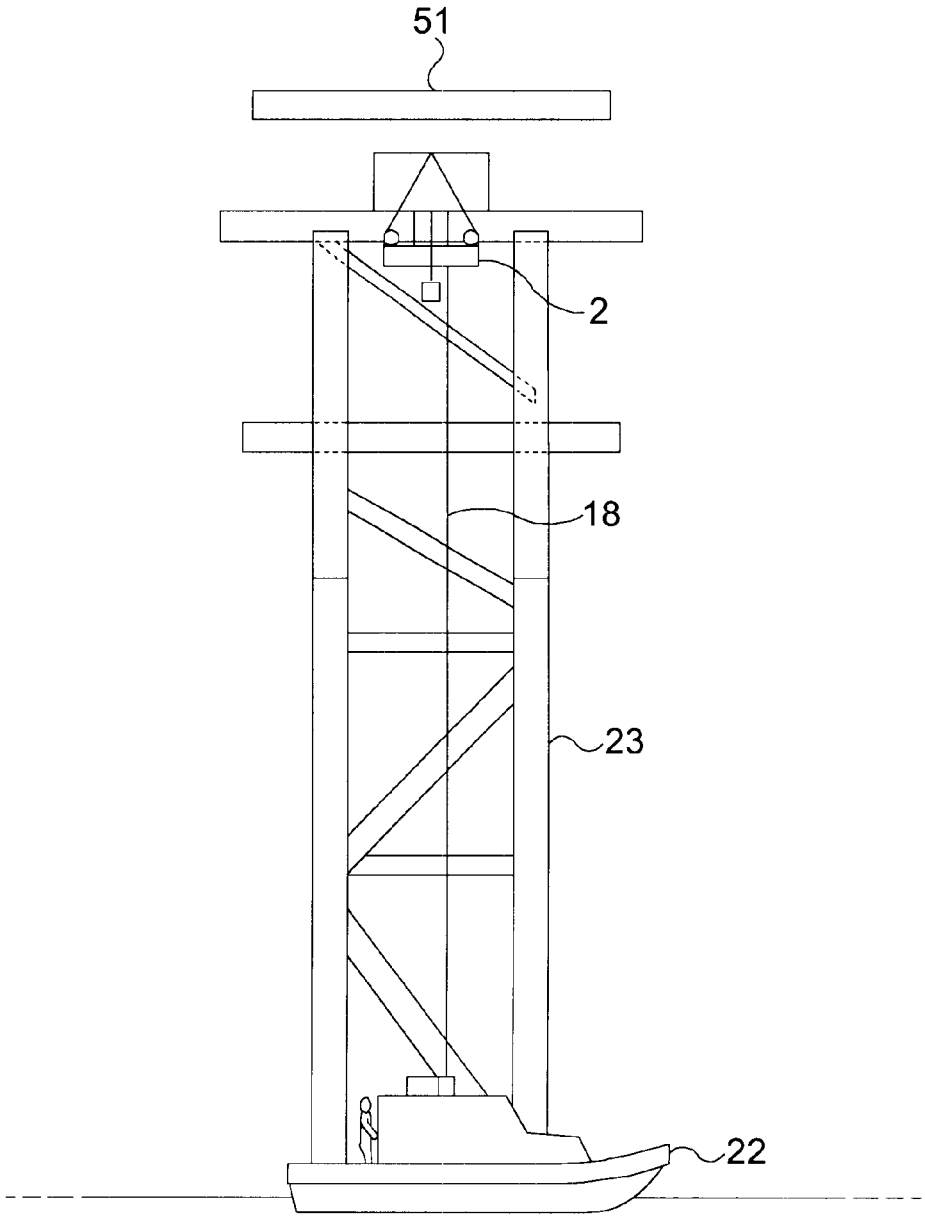
Figure 13:
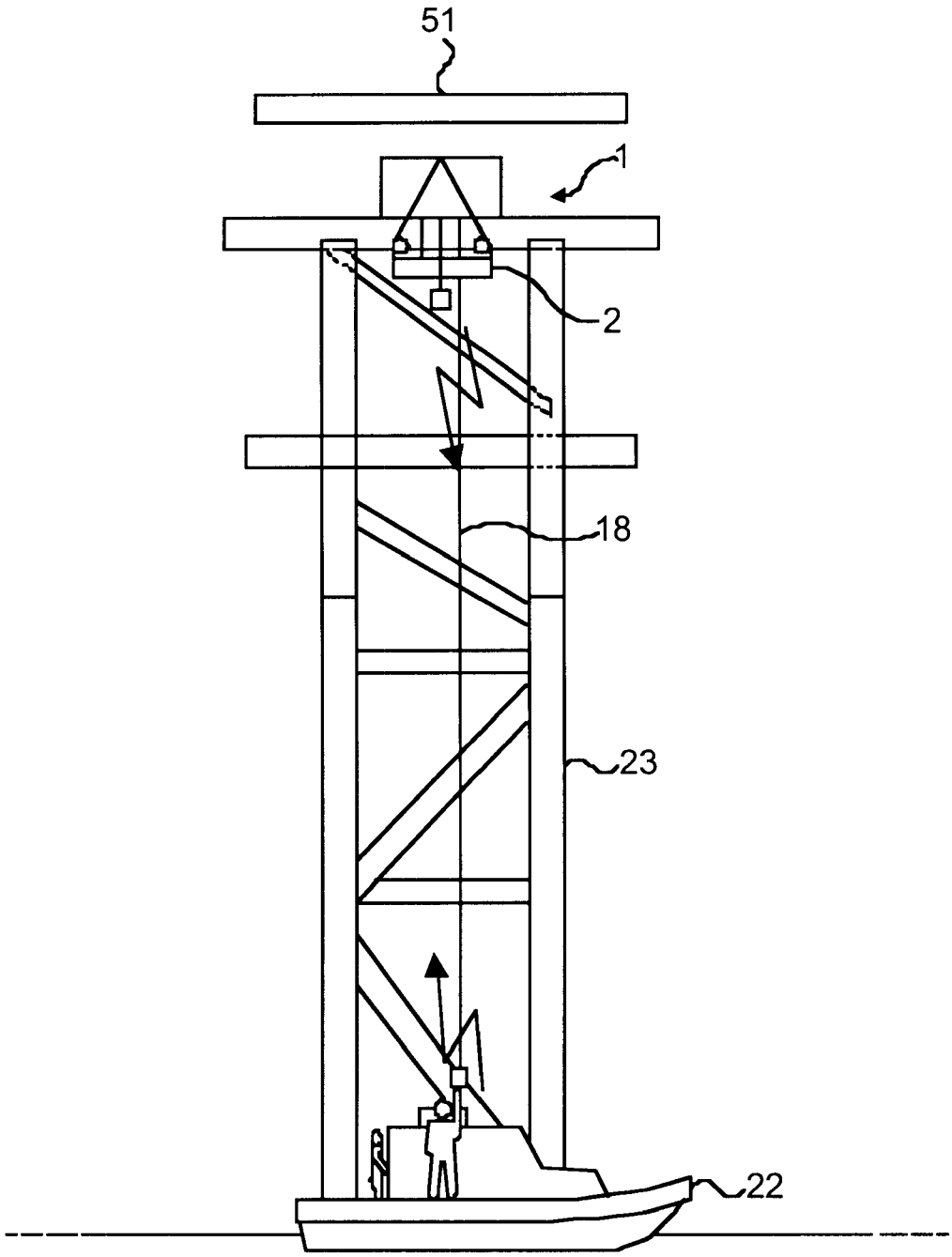

The connectors 4 between the frame and craft are released and the craft is lowered to the water (FIG. 11). The load-bearing line 15 is then released from the craft and a signal sent to the apparatus 1 to raise the load-bearing line and the frame 2. The crew holds the heading of the craft while the apparatus 1 is recovered to the main deck of the platform (FIG. 12). Once recovery of the apparatus is complete, the umbilical line 18 is disconnected from the craft and a signal (e.g. the radio signal) sent to the apparatus to raise the umbilical line (FIG. 13).

Figure 14:
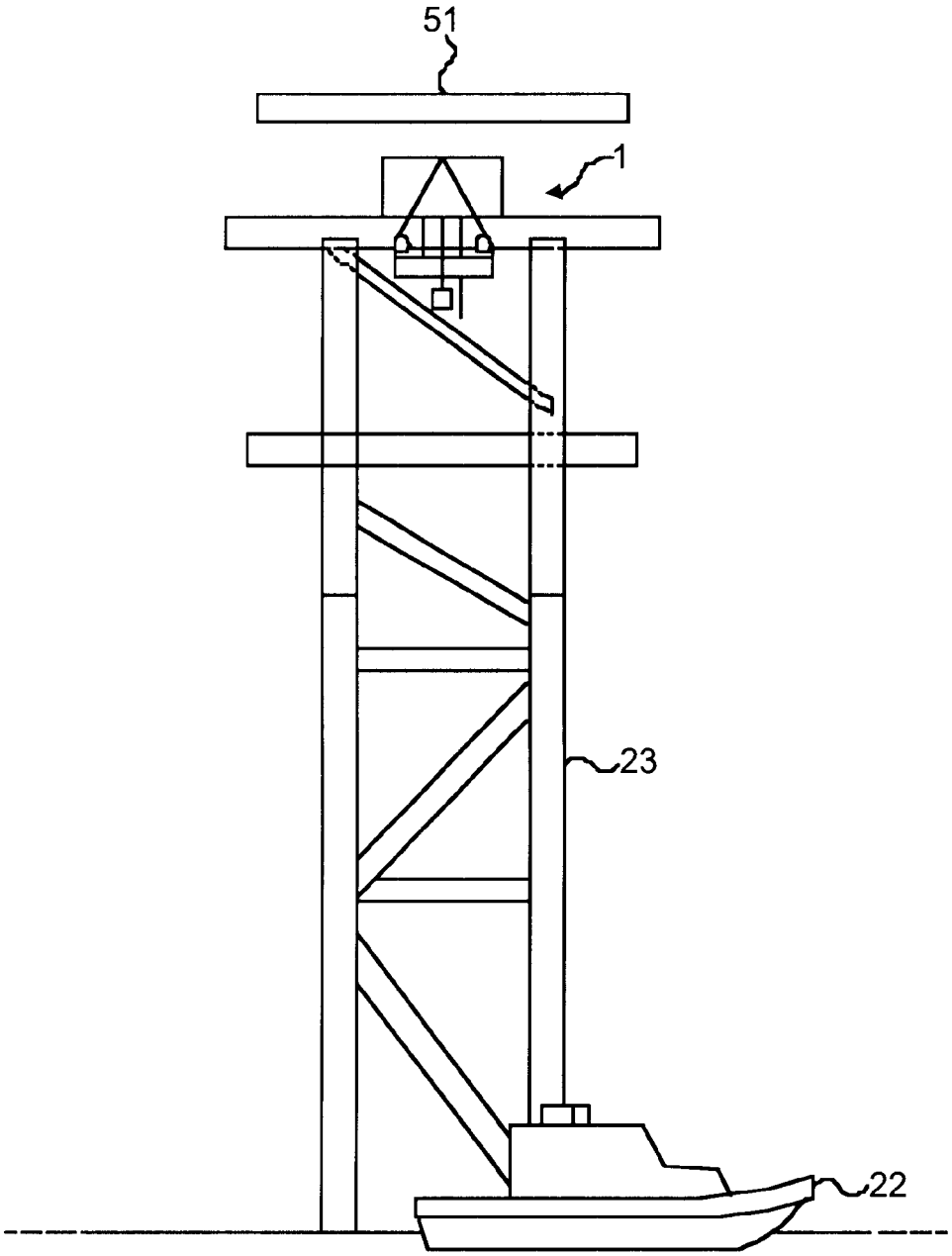

Once the umbilical line 18 is seen to be stored safely in the apparatus, the craft can power away from the platform (FIG. 14).

Figure 15:
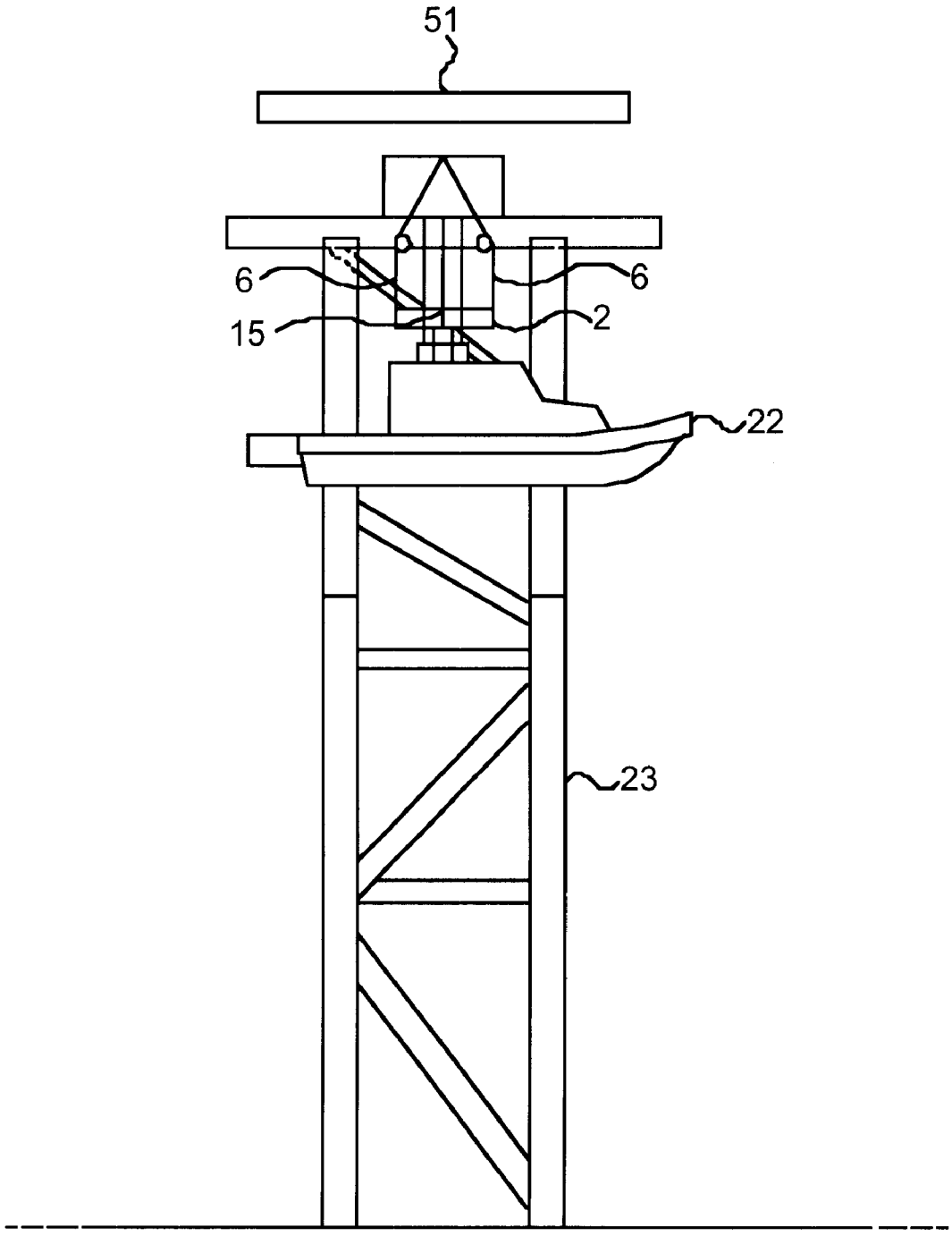
Figure 16:
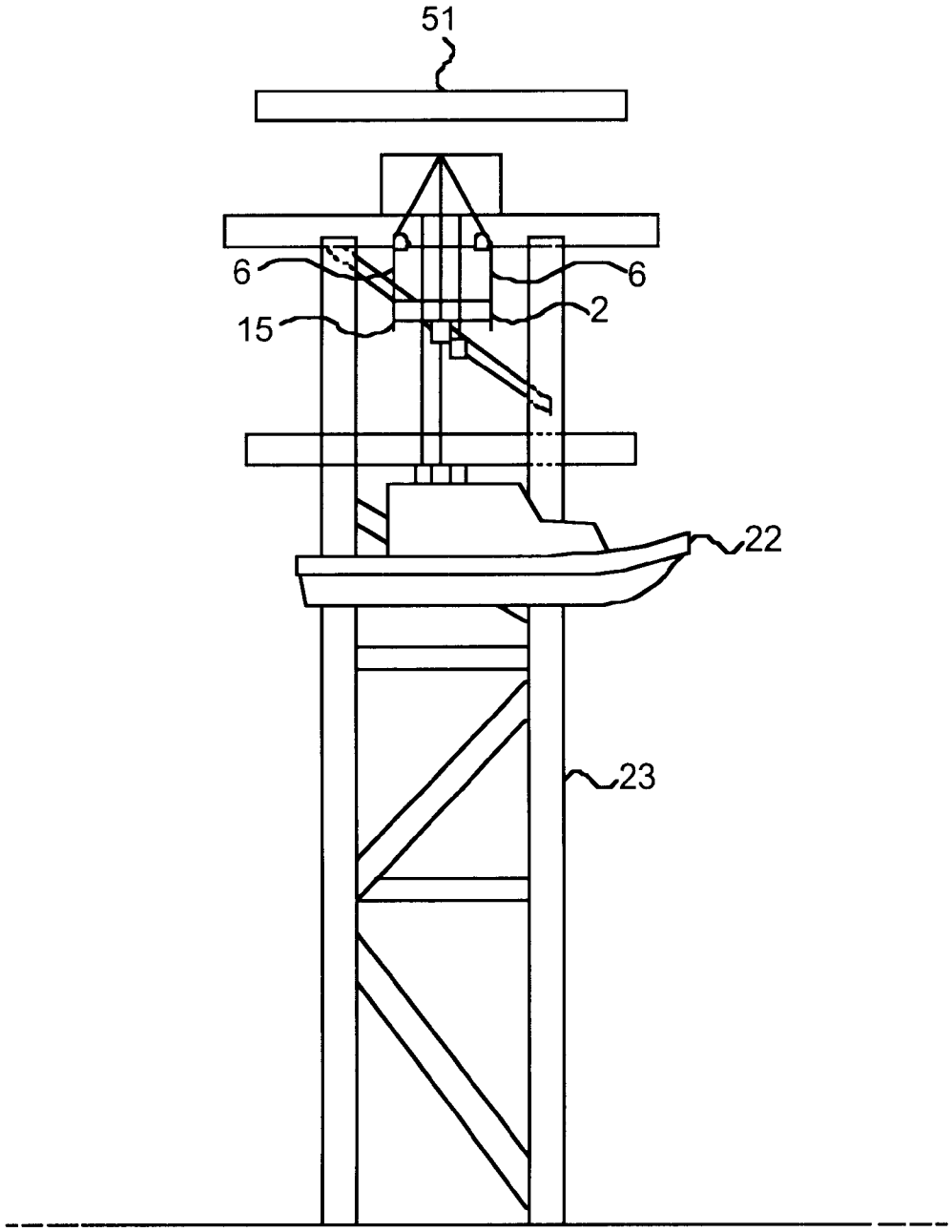
Figure 17:
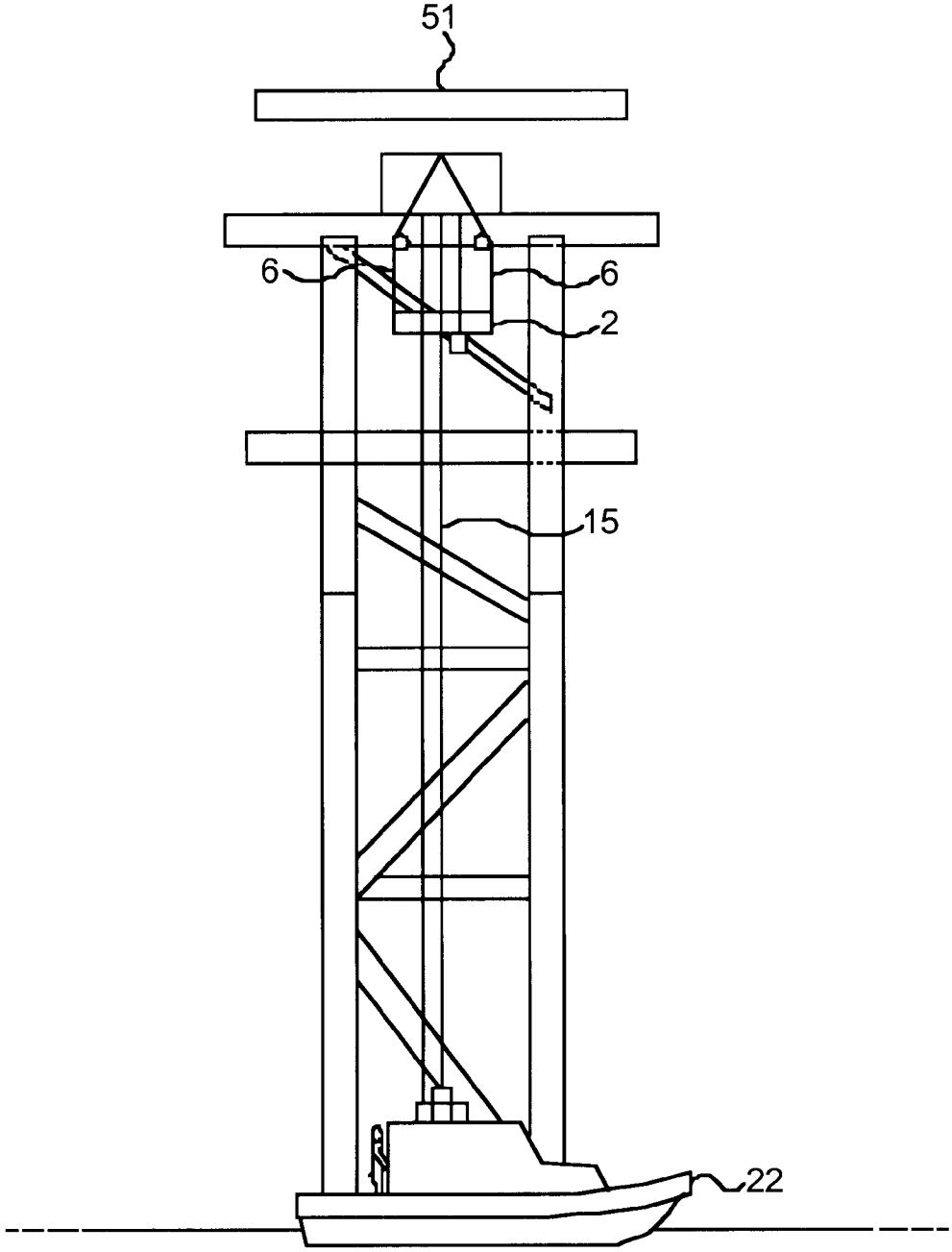
Figure 18:
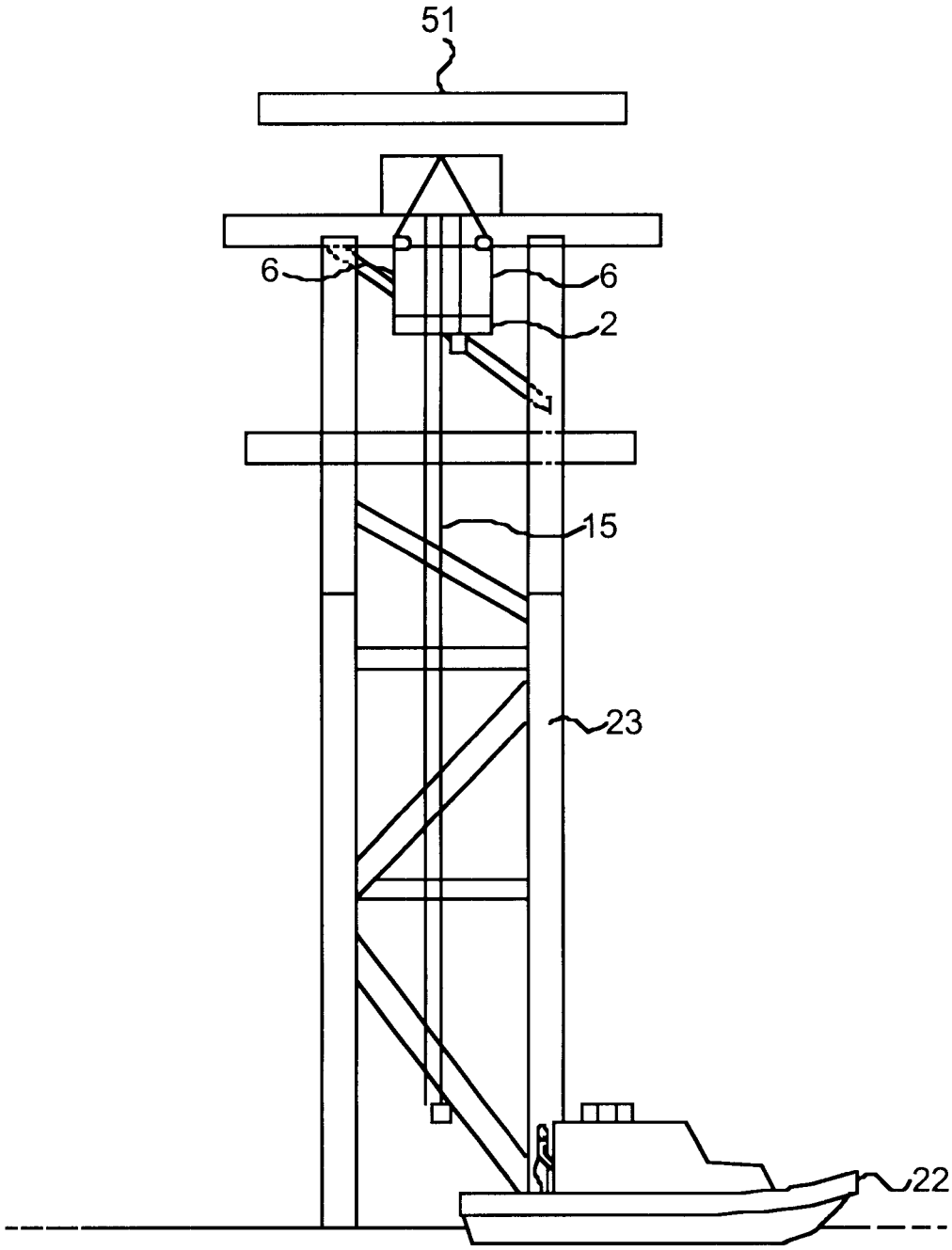

In the event of an emergency occurring whilst the craft is docked at the top of the platform, the crew can return to the craft 22 and the craft is then released from the securing means and from the connector means 4 and from the lifting frame 2 (FIG. 15). The craft is then lowered by the manual brake control 10 on the winch 12 (FIG. 16). When the craft reaches the water the load-bearing line 15 is then released automatically (FIG. 17) by hydrostatic release and the craft powers away from the platform (FIG. 18).

It is apparent from the foregoing description that the use of the apparatus described is limited by few weather conditions including fog. As the craft is securely docked to the frame and also connected to the platform by the load-bearing line, the stability of the craft is greatly increased during launch or recovery from use of a single load line.

Furthermore, as the secondary lines 6 connected to the frame 2 do not require manual connection to loading points on the craft 22 while in the water, this reduces the risk to crew members during the connection process. Additionally, it is envisaged that the connectors 4 on the underside of the frame will be suitable for connection to a range of craft sizes thereby standardising the equipment required for launch and recovery of various crafts.

Figure 6:
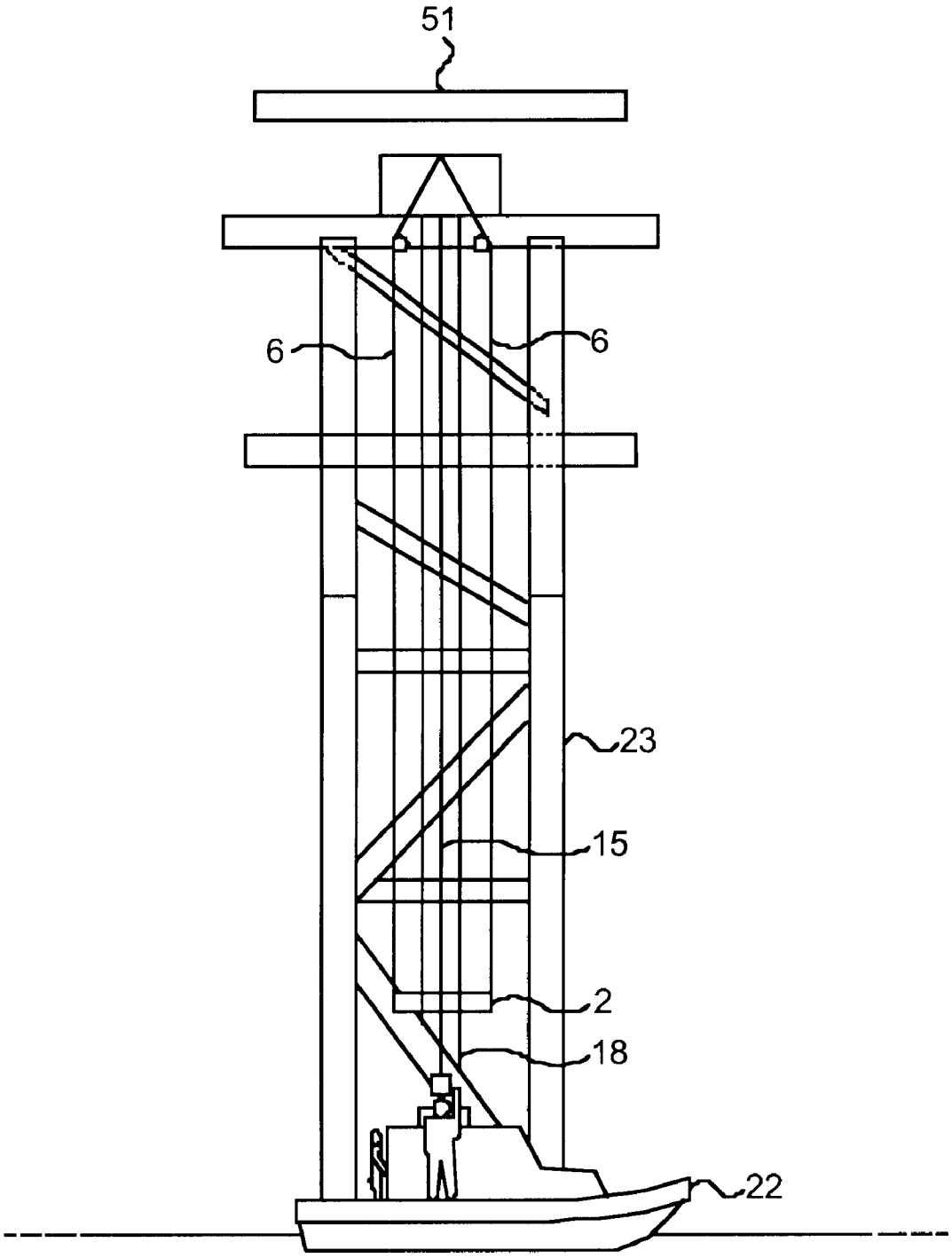

Another advantage is that the frame 2, being relatively heavy, acts as a load member so that its weight normally keeps the secondary lines taut and it hangs in a stable position a short distance above the craft, in the situation shown FIG. 5. This would not be possible if the secondary lines were to be suspended in adverse weather and sea conditions without loading on their lower ends. Furthermore, the frame then acts as a guide for the primary line 15, when it is lowered the short distance for engaging the connector 17 on the free end of the line with the corresponding loading point on the craft (FIG. 6).

It is a further advantage of the apparatus and method described that launch and recovery operations are less hazardous for the crew than a helicopter transfer, thereby maximising the crew members safety. In addition, the cost of the unmanned offshore platform is lower than an equivalent one having a helicopter landing deck and crew quarters. If need be, the support craft can serve to provide accommodation and facilities for the crew. Additionally, lower noise levels improve comfort during transit.

The apparatus itself is formed from known components, which allows for swift replacement in the event of a malfunction. Furthermore, the apparatus can be quickly retrofitted to existing vessels and platforms.

In a further embodiment of the invention, guide wires may be suspended from the underside of the frame of the apparatus and anchored either temporarily or permanently to the platform itself (specifically to the platform legs), or to a submerged object adjacent to the platform. The craft is secured at either bow or stern to the guide wires which act to guide the craft during launch and recovery operations.

Additionally, the guide wires may pass through running clamps in the craft to support the craft in the event of failure of the load-bearing line, hook or winches during use. In such an event, the craft can be safely lowered to the water by controlled feeding of the guide wires through the running clamps.

In a still further embodiment of the invention, a haul-down rope may be suspended from the frame, which, in severe weather conditions would be recovered and led through a docking plate on the craft and fed onto a hand operated winch, to control craft orientation when lifting into the frame. This haul-down rope would then be used to guide the frame into engagement with the docking members on the craft.

A description is now given of the electrical circuitry installed on the platform, with reference to FIG. 19. As shown, a first electrical circuit 63 is powered by a self-sustainable power supply comprising one or more energy sources 59, 66 and rechargeable batteries 64, 65, together constituting the battery bank 58 (FIG. 1). Battery 64 is an instrumentation battery and battery 65 is a navigational aid battery, but these also supply power to hydraulic package 69 for powering one or more hydraulic devices, or umbilical winch 82, in the event of a power failure from the self-sustainable energy source 59, 66. These batteries 64, 65 are recharged by the self-sustainable energy sources, exemplified as a thermal electric generator 59 (see FIG. 1) and a photo-voltaic solar source 66 serving as alternative energy source. Suitable alternative forms of self-sustainable energy source are wind or wave generators. The electrical circuit 63 includes one or more electrical devices. For example, such devices include navigational aids which are supplied from supply line 67, platform instrumentation which is supplied from supply line 68, hydraulic package 69 and a motor drive 82 for driving the tension reel 19 to lower and raise the umbilical power line 18 (FIG. 2). Accordingly, the electrical circuit 63 powered by the self-sustainable power supply provides all essential operational functions needed at any time when there are no crew members working on the platform.

Additionally, a second electrical circuit 70 is provided, connected to the umbilical line 18. Electrical circuit 70 includes a distribution board 71 for small power needs, such as lighting, the davit winch motors 13, 61 for the primary and the secondary lines and the drive motor 72 of an optional platform crane (not shown). The second electrical circuit is powered from a generator 73 on board the support craft 22 when the lowered umbilical line 18 is connected to generator 73 via connector 21.

It will be appreciated that the electrical devices powered by the renewable energy sources 59, 66 operate at low voltage (e.g. 24 volts dc) and low current, whereas the electrical devices powered by the second electrical circuit 70 consume significantly more power and operate at higher voltage (e.g. 400 volts ac).

As shown in FIG. 19, the high voltage circuit 70 is connected to the low voltage circuit via one-way converters 74, 75 so that when the generator 73 is supplying power to the high voltage electrical circuit 70, it also serves to recharge the navigational aids battery 65 and the instrumentation battery 64, and to power the low voltage circuit 63 and all electrical devices connected in that circuit.

In operation, once the umbilical line 18 has been lowered and connected to the generator 73 on board the support craft 22, the generator 73 maintains all electrical functions on the platform. This means that once the crew have transferred from the craft to the platform, all the electrical devices on the platform can be used. In particular, the crew then have full support for all necessary maintenance activities. In effect, under these conditions, the generator 73, which can generate a relatively large voltage (400 volts ac), becomes integrated with the electrical circuitry on board the offshore platform. It will be appreciated, therefore, that the generator 73 also generates the power necessary to operate the existing apparatus 1, for raising the craft 51 from the sea surface up to the main deck of the platform.

The generator 73 may be a stand-alone generator run independently of the marine engine of the support craft 51. However, it is preferred that generator 73 is coupled to be driven by the marine engine. Since marine engines are normally water-cooled and since electrical power needs to be generated while the craft 51 is raised out of the water, the marine engine needs to be designed or adapted such that it can be cooled without sea water. For example, a platform based cooling system may be used. Alternatively, a cooling system which is independent of the normal cooling system on the craft can be carried on board the support craft.

It will be appreciated that a particular advantage of the described system is that the craft 51 can provide accommodation and comfort for the crew with rest and catering facilities, without these having to be provided in the platform superstructure. Furthermore, the crew can maintain communication with the platform control centre via the VHF communication facilities that are provided on board the craft.

A modification is diagrammatically shown in FIG. 20. In this modification, a hydraulic motor 93 driven by the marine engine of the support craft 22 or from a stand-alone engine can be used to provide hydraulic power which is delivered through a hydraulic umbilical 94 lowered in similar fashion to the electrical umbilical line 18 in the previous embodiment, to drive a hydraulic motor 95 for operating the davit winch motors or a hydraulic motor 96 for operating an optional platform crane.

The systems and methods described above are especially designed for use in hostile environments such as encountered in the North Sea. However, the concept of integrating the generator 73 on board the craft with the electrical systems of the platform when maintenance work is to be carried out can also be applied where the platform is in a calmer environment not necessitating any special measure for transferring the support vessel's crew to the offshore platform. Under those circumstances, there is no need to provide any davit for raising the support vessel to the main deck and lowering it back into the sea after the maintenance work has been completed. The crew would merely dock the support craft alongside the platform and transfer across to the platform main deck from the floating craft. This can be done by the crew transferring from the craft to a landing stage or the like at the base of the platform, after which the crew climb up a ladder onto the main deck. Alternatively, the crew could be winched up from the craft to the platform deck by a suitable winching apparatus on the deck, remotely operated from the support craft. In this case, the umbilical line (whether electrical or hydraulic) could be permanently connected to a connector secured to the platform leg structure at a location accessible for the crew, who would connect an output line from the generator (or hydraulic motor) on the support craft to the connector, for powering the equipment on board the platform. Alternatively the connector could be mounted so as to be accessible to the crew while they are still on board the sea-going craft. Another possibility is for the connector to be provided in the superstructure itself, so that the crew have to transfer to the superstructure, before they can connect a line from the generator on the craft to the connector.

FIG. 21 shows another modification in which a helicopter landing deck 80 is provided atop the superstructure, to allow for helicopter landing as a means of secondary access and allow well intervention work where the packages are lifted on board using the platform crane. In this instance, the laydown areas would be fitted with gas tight well hatches to allow helicopter operations to take place while the offshore platform is operational.

What is claimed is:

1. A system for use in performing maintenance work on an unmanned offshore platform, comprising a sea-going support craft for transporting a maintenance crew to the platform for performing maintenance work on the platform, a power generator on the craft, and at least one operating device on the platform, the platform having a line connected at one end to said operating device and provided with connector means at its other end, the power generator being connectable to the connection means when the support craft is in attendance on the platform such that the power generator can supply power to said operating device.

2. A system according to claim 1, wherein the or one of the operating devices is a hoisting apparatus for raising the support craft to an elevated position, enabling the crew to transfer from the craft to the platform superstructure.

3. A system according to claim 1 or 2, wherein means remotely operable from the craft, are provided on the platform for lowering the line to the craft.

4. A system according to claim 1 or 2, wherein the power generator is an electrical power generator.

5. A system according to claim 2, wherein the power generator is an electrical power generator and said electrical power generator is arranged to be driven by the marine engine of said craft, said engine being adapted to run when the support craft is held in its elevated position.

6. A system according to claim 2, wherein the power generator is an electrical power generator and said electrical generator is arranged to run independently of the marine engine of said craft, the generator being adapted to run when the support craft is held in its elevated position.

7. An unmanned offshore platform having a self-sustainable power supply, a first electrical circuit including at least one first electrical device arranged to be powered by the power supply, and a second electrical circuit including at least one second electrical device, said second electrical circuit having no permanent power source on board the platform but having an electrical connection means for connecting to an external source of power on a sea-going support craft for transporting maintenance crew to the platform.

8. An unmanned offshore platform according to claim 7, wherein the self-sustainable power supply comprises a self-sustainable energy source and a battery arranged to be recharged by the self-sustainable energy source.

9. An unmanned offshore platform according to claim 8 and including two or more self-sustainable energy sources to provide alternative sources of energy.

10. An unmanned offshore platform according to claim 8, wherein the self-sustainable energy source is a thermal electric generator arranged to burn gas from a gas well, for which said platform is a production platform.

11. An unmanned offshore platform according to claim 8 or 10, wherein the self-sustainable energy source is a photovoltaic solar source.

12. An unmanned offshore platform according to claim 8 or 9, wherein the second electrical circuit is connected to the first electrical circuit through one-way converter means, to enable to external source of power on the support craft to re-charge the battery and energize the first electrical circuit when said external source of power is connected to the second electrical circuit.

13. An unmanned offshore platform according to any one of claims 7 to 10, wherein the at least one first electrical device comprises at least one of (i) a motor for driving a hydraulic package, (ii) a motor for operating an umbilical winch for lowering to the support craft an umbilical power line connected between said second electrical circuit and said connection means, (iii) instrumentation and (iv) navigational aids.

14. An unmanned offshore platform according to claim 13, wherein the umbilical winch motor is operable by remote control from the support craft, or from a host platform.

15. An unmanned offshore platform according to any one of claims 7 to 9, wherein the at least one second electrical device(s) comprise at least one of (i) a winch motor for raising and lowering the support craft between sea level and an elevated position alongside a platform superstructure (ii) an electrically powered crane on the platform and (iii) an electrical distribution board.

16. An unmanned offshore platform according to any one of claims 7 to 9, including a support craft, raising and lowering apparatus on a platform superstructure, comprising a primary load-bearing line for connection to the craft, means operable for raising and lowering the primary line, a load member, a plurality of secondary lines connected to the load member, docking means on the load member for engagement with corresponding docking means on the support craft, and means operable for raising and lowering the secondary lines independently of the load bearing line, said load member acting as a guide for the primary line.

17. A system for use in performing maintenance work on an unmanned offshore platform, comprising a sea-going support craft for transporting a maintenance crew to the platform, an operating device on the platform, a hoisting apparatus on the platform which can be coupled to said support craft and is operable therefrom to raise the support craft from the sea to an elevated position alongside the platform superstructure, means on the platform remotely operable from the craft for lowering a line, connected to said operating device and said hoisting apparatus, to the craft before it is raised from the sea, and connector means for connecting the lowered line to the craft such that the latter can supply power to said operating device and said hoisting apparatus.

18. A method of performing maintenance work on an unmanned offshore platform using a maintenance crew, wherein the crew:

(i) are transported in a sea-going support craft to the platform;

(ii) connect a hydraulic pressure source on the craft to a hydraulic hoisting apparatus on the offshore platform;

(iii) operate the hoisting apparatus from the craft to raise the support craft from the sea to an elevated position;

(iv) transfer from the craft in elevated position to the platform superstructure; and (v) perform said maintenance work.

19. A method according to claim 18, wherein after said maintenance work has been completed, the crew transfer back to the support craft in the elevated position, operate the hoisting apparatus to lower the craft down to the sea, and are transported away from the offshore platform in the craft.

20. A system for use in performing maintenance work on an unmanned offshore platform, comprising a sea-going support craft for transporting a maintenance crew to the platform, a hydraulic pressure source on the support craft, a hydraulic hoisting apparatus on the platform which can be coupled to said support craft and is operable therefrom to raise the support craft from the sea to an elevated position alongside the platform superstructure, means on the platform remotely operable from the craft for lowering a hydraulic line, connected to said hoisting apparatus, to the craft before it is raised from the sea, and connector means for connecting the lowered line to said hydraulic pressure source, such that the latter can supply hydraulic power to said hoisting apparatus.

21. A system according to claim 2, claims 5 or 6 as appended to claim 2, or claim 17 or claim 20, wherein the hoisting apparatus comprises a primary load-bearing line for connection to the craft, means operable for raising and lowering the primary line, a load member, a plurality of secondary lines connected to the load member, docking means on the load member for engagement with corresponding docking means on the support craft, and means operable for raising and lowering the secondary lines independently of the load bearing line, said load member acting as a guide for the primary line.

22. A method of performing maintenance work on an unmanned offshore platform using a maintenance crew, wherein the crew:

(i) are transported in a sea-going support craft to the platform;

(ii) transfer from the craft, floating alongside the platform, to the platform superstructure;

(iii) connect one end of a line of the platform, connected at its other end to an operating device on the superstructure, to a generator of power on the craft, for energising said operating device; and (iv) perform said maintenance work, step (iii) being performed before, during or after step (ii).

23. A method according to claim 22, wherein the generator of power, the line and the operating device are all hydraulic.

24. A method according to claim 23, wherein the generator of power, the line and the operating device are all electrical.

* * * * *